US012276467B2

(12) United States Patent
Spector et al.

(10) Patent No.: US 12,276,467 B2
(45) Date of Patent: Apr. 15, 2025

(54) SOUND, FLASH, AND HEAT DISSIPATING FIREARM SUPPRESSOR

(71) Applicant: RFPH, LLC, Stafford, TX (US)

(72) Inventors: David Morris Spector, Missouri City, TX (US); Phillip Eugene Haag, Jr., Richmond, TX (US); Ran Tamir, Sugar Land, TX (US)

( * ) Notice: Subject to any disclaimer, the term of this patent is extended or adjusted under 35 U.S.C. 154(b) by 0 days.

(21) Appl. No.: 18/126,256

(22) Filed: Mar. 24, 2023

(65) Prior Publication Data

US 2024/0035771 A1 Feb. 1, 2024

Related U.S. Application Data

(63) Continuation-in-part of application No. 17/091,992, filed on Nov. 6, 2020, now Pat. No. 11,668,540, and a continuation-in-part of application No. 29/882,313, filed on Jan. 12, 2023, and a continuation-in-part of application No. 29/882,316, filed on Jan. 12, 2023, and a continuation-in-part of application No. 29/882,317, filed on Jan. 12, 2023, now Pat. No. Des. 1,058,741.

(60) Provisional application No. 62/961,830, filed on Jan. 16, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 2,065,273 A * 12/1936 Galliot ..... F41A 21/36 89/14.3
2,143,596 A * 1/1939 Galliot ..... F41A 21/36 89/14.3
3,837,107 A 9/1974 Swaim et al.
(Continued)

OTHER PUBLICATIONS

Singhal, Anshul, Parveen Mallika; "Air Flow Optimization via a Venturi Type Air Restrictor"; Proceedings of the World Congress of Engineering 2013 Vol III, Jul. 3-5, 2013 (Year: 2013).*
(Continued)

*Primary Examiner* — Joshua E Freeman
*Assistant Examiner* — Benjamin S Gomberg
(74) *Attorney, Agent, or Firm* — Frost Brown Todd LLP

(57) ABSTRACT

Embodiments described herein relate to suppressors for reducing or eliminating sound, flash, and/or heat generated by firearms while discharging projectiles. The suppressor includes a unitary structure containing a cone shaped nozzle disposed at one end of a body. The body has a plurality of baffles surrounding a central bore, a breech end opposite a faceplate, and a plurality of cooling channels spanning a length of the body. Each cooling channel has a first opening at the breech end and a second opening at the faceplate. The unitary structure further contains an outer ring spanning from the breech end to at least the faceplate, a longitudinal wall spanning from the breech end to the faceplate, and a plurality of radially oriented walls extending between the longitudinal wall and the outer ring. The plurality of cooling channels is disposed between the longitudinal wall, the outer ring, and the radially oriented walls.

15 Claims, 14 Drawing Sheets

(56) References Cited

U.S. PATENT DOCUMENTS

| | | | | |
|---|---|---|---|---|
| D280,655 | S | 9/1985 | Cellini | |
| D285,238 | S | 8/1986 | Cellini | |
| D296,350 | S | 6/1988 | Cellini | |
| 5,305,677 | A | 4/1994 | Kleinguenther et al. | |
| D435,884 | S | 1/2001 | Dehaan | |
| 6,192,612 | B1 | 2/2001 | Maier et al. | |
| D585,518 | S | 1/2009 | Brittingham | |
| 8,322,266 | B2 | 12/2012 | Presz, Jr. et al. | |
| 8,453,789 | B1 | 6/2013 | Honigmann et al. | |
| 8,522,662 | B2 * | 9/2013 | Presz, Jr. | F41A 13/08 89/14.3 |
| 8,826,793 | B2 | 9/2014 | Oliver | |
| 8,844,422 | B1 | 9/2014 | Klett | |
| 8,875,612 | B1 | 11/2014 | Klett et al. | |
| 9,052,152 | B2 | 6/2015 | Moss | |
| 9,086,248 | B2 | 7/2015 | Young et al. | |
| 9,316,456 | B1 | 4/2016 | Oliver | |
| D761,373 | S | 7/2016 | Lessard | |
| D764,621 | S | 8/2016 | Dueck et al. | |
| 9,470,466 | B2 | 10/2016 | Washburn, III et al. | |
| D776,226 | S | 1/2017 | Green et al. | |
| D779,621 | S | 2/2017 | Salvador | |
| D792,545 | S | 7/2017 | Green et al. | |
| 9,777,979 | B2 | 10/2017 | Washburn, III et al. | |
| 9,835,399 | B1 * | 12/2017 | Lessard | F41A 21/30 |
| D810,224 | S | 2/2018 | Lessard | |
| 9,982,959 | B2 | 5/2018 | Washburn, III et al. | |
| 10,126,084 | B1 | 11/2018 | Oglesby | |
| D839,375 | S | 1/2019 | James | |
| D842,419 | S | 3/2019 | Edminster et al. | |
| 10,222,162 | B2 | 3/2019 | Adamson, Jr. | |
| 10,288,374 | B1 | 5/2019 | Fricke et al. | |
| 10,330,420 | B2 | 6/2019 | Kunsky et al. | |
| D860,372 | S | 9/2019 | Riley | |
| D876,575 | S | 2/2020 | Delgado Acarreta et al. | |
| 10,634,445 | B1 | 4/2020 | Klett | |
| D888,871 | S | 6/2020 | Alomaira | |
| 10,677,555 | B2 | 6/2020 | Fricke et al. | |
| 10,690,431 | B2 | 6/2020 | Washburn, III et al. | |
| 10,890,404 | B2 * | 1/2021 | Petersen | F41A 21/30 |
| D910,139 | S | 2/2021 | Chin | |
| 11,125,523 | B2 * | 9/2021 | Petersen | F41A 21/30 |
| D955,524 | S | 6/2022 | Spector et al. | |
| 2013/0312592 | A1 | 11/2013 | Storrs et al. | |
| 2015/0184968 | A1 | 7/2015 | Fischer et al. | |
| 2016/0123689 | A1 | 5/2016 | Maeda | |
| 2017/0205174 | A1 * | 7/2017 | Petersen | F41A 21/30 |
| 2019/0204038 | A1 | 7/2019 | Conner | |
| 2019/0257607 | A1 * | 8/2019 | Dobrinescu | F41A 21/30 |
| 2019/0285375 | A1 | 9/2019 | Hartwell | |
| 2019/0331449 | A1 | 10/2019 | Marfione | |
| 2019/0376758 | A1 | 12/2019 | Tiziani | |
| 2020/0103194 | A1 | 4/2020 | Oliver | |
| 2020/0141679 | A1 * | 5/2020 | Garst | F41A 21/30 |
| 2020/0173751 | A1 | 6/2020 | Dorne et al. | |
| 2020/0224989 | A1 * | 7/2020 | Bundy | F41A 21/325 |
| 2021/0003360 | A1 * | 1/2021 | Kras | F41A 21/30 |
| 2021/0071979 | A1 * | 3/2021 | Plunkett, Jr. | F41A 21/30 |
| 2021/0254921 | A1 | 8/2021 | Spector et al. | |
| 2021/0404760 | A1 | 12/2021 | Hipp | |
| 2022/0057160 | A1 | 2/2022 | Johns et al. | |
| 2024/0133650 | A1 * | 4/2024 | Oliver | F41A 21/30 |

OTHER PUBLICATIONS

Israeli Office Action dated Jan. 20, 2021 for Application No. 65544.

Cox, Matthew. "US Special Operators Could Use This New Suppressor That Relies on WWI Technology" Posted: Jan. 22, 2020 [visited: Jan. 5, 2021] Military.com URL:https://www.military.com/daily-news/2020/01/22/us-special-operators-could-use-new-suppressor-relies-wwi-technology.html (Year: 2020).

The Dead District. "New Suppressor That Relies on #WWI Technology" Tweeted: Jan. 23, 2020 [visited: Jan. 5, 2021] Twitter URL: https://twitter.com/TheDeadDistrict/status/1220272357039919104 (Year: 2020).

Van Nostrand Company. Operation and Tactical Use of the Lewis Automatic Machine Rifle. Published: 1917 [visited: Jan. 5, 2022] Fenrir.com URL: http://www.fenrir.com/free_stuff/lewis/003.htm (Year: 1917).

Israeli Office Action dated Mar. 28, 2024 for Application No. 279761, 4 pages.

* cited by examiner

SOUND, FLASH, AND HEAT DISSIPATING FIREARM SUPPRESSOR

CROSS-REFERENCE TO RELATED APPLICATIONS

This application is a continuation-in-part of U.S. application Ser. No. 17/091,992, filed Nov. 6, 2020, which claims benefit of U.S. Prov. Appl. No. 62/961,830, filed Jan. 16, 2020, this application is a continuation-in-part of U.S. Design application No. 29/882,313, filed Jan. 12, 2023, this application is a continuation-in-part of U.S. Design application No. 29/882,316, filed Jan. 12, 2023, and this application is a continuation-in-part of U.S. Design application No. 29/882,317, filed Jan. 12, 2023, which are all herein incorporated by reference.

BACKGROUND

Field

Embodiments of the present disclosure generally relate to firearm suppressor technology, and more specifically, to suppressors which reduce or eliminate sound, flash, and/or heat generated by a firearm while in use.

Description of the Related Art

Firearm suppressors (also known as silencers) greatly reduce the audible report from a gaseous explosion that occurs when firing a round (e.g., discharging a projectile or bullet) from a barrel of a firearm. While mitigating sound, suppressors also mitigate the muzzle flash associated with burning gunpowder exiting the barrel of the firearm during firing. Because suppressors allow the user to operate firearms without the need for hearing protection, they have become very popular for use in military, law enforcement and civilian applications. However, heat absorbed by conventional suppressors during use raises the temperature of the suppressor to levels that may cause burns, which produces a safety risk to a user.

In particular, military applications often require firing multiple rounds in a short time period. For example, belt-fed firearms allow firing hundreds of rounds in a few minutes or less, which elevates the temperature of a suppressor connected to the firearm to 1,000° F., or greater. These elevated temperatures can severely damage or completely destroy conventional suppressors.

Accordingly, there is a need for suppressors which mitigate sound, flash, and/or heat generated by a firearm while in use.

SUMMARY

Embodiments described herein relate to suppressors for reducing or eliminating sound, flash, and/or heat generated by firearms while discharging projectiles.

In one or more embodiments, a suppressor is provided and includes a unitary structure containing a body having a plurality of baffles surrounding a central bore. The body has an interior volume and a cone shaped nozzle disposed at one end of the body. The body has a breech end opposite a faceplate and contains a plurality of cooling channels spanning a length of the body. The central bore extends from the breech end of the body to the faceplate. The plurality of cooling channels terminates at the faceplate of the body. Each of the cooling channels has a first opening at the breech end and a second opening at the faceplate. The unitary structure further contains an outer ring spanning from the breech end to at least the faceplate, a longitudinal wall spanning from the breech end to the faceplate, where the longitudinal wall is disposed radially inward of the outer ring, and a plurality of radially oriented walls extending between the longitudinal wall and the outer ring. The plurality of cooling channels is disposed between the longitudinal wall, the outer ring, and the radially oriented walls.

In some embodiments, a suppressor is provided and includes a unitary structure containing a body having a plurality of baffles surrounding a central bore. The unitary structure contains a body having an interior volume and a cone shaped nozzle disposed at one end of the body. The body has a breech end opposite a faceplate and contains a plurality of cooling channels spanning a length of the body. The plurality of cooling channels terminates at the faceplate of the body. Each of the cooling channels has a first opening at the breech end and a second opening at the faceplate. The unitary structure further contains an outer ring spanning from the breech end to at least the faceplate, a longitudinal wall spanning from the breech end to the faceplate, where the longitudinal wall is disposed radially inward of the outer ring, and a plurality of radially oriented walls extending between the longitudinal wall and the outer ring. The plurality of cooling channels is disposed between the longitudinal wall, the outer ring, and the radially oriented walls. The unitary structure further contains a flash hider extending from the faceplate into a muzzle chamber within the cone shaped nozzle. The flash hider has from 2 prongs to 8 prongs extending into the muzzle chamber and the central bore passes between the prongs.

In other embodiments, a suppressor is provided and includes a unitary structure containing a body having a plurality of baffles surrounding a central bore. The unitary structure contains a body having an interior volume and a cone shaped nozzle disposed at one end of the body, where the body has a breech end opposite a faceplate and contains a plurality of cooling channels spanning a length of the body. The plurality of cooling channels terminates at the faceplate of the body. Each of the cooling channels has a first opening at the breech end and a second opening at the faceplate. The unitary structure further contains an outer ring spanning from the breech end to at least the faceplate and a longitudinal wall spanning from the breech end to the faceplate, where the longitudinal wall is disposed radially inward of the outer ring. The unitary structure also contains a plurality of radially oriented walls extending between the longitudinal wall and the outer ring. The plurality of cooling channels is disposed between the longitudinal wall, the outer ring, and the radially oriented walls. The outer ring and the cone shaped nozzle form a venturi angle having a range from about 155° to about 170° within the unitary structure.

In one or more embodiments, a suppressor is provided and includes a unitary structure containing a body having an interior volume and a cone shaped nozzle disposed at one end of the body, wherein the body includes a plurality of cooling channels spanning a length of the body, and a plurality of internal channels that is formed radially inward of the cooling channels, and both of the plurality of cooling channels and the plurality of internal channels terminating in a faceplate of the body, a central bore is formed from a breech end of the body to the faceplate, and a plurality of baffles surround the central bore.

In some embodiments, a suppressor is provided and includes a unitary structure containing a body having an interior volume and a cone shaped nozzle disposed at one end of the body, wherein the body includes a plurality of cooling channels spanning a length of the body, and a plurality of internal channels that is formed radially inward of the cooling channels, and both of the plurality of cooling channels and the plurality of internal channels terminating in a faceplate of the body, a central bore is formed from a breech end of the body to the faceplate, and a plurality of baffles surrounding the central bore, wherein a portion of the plurality of baffles defines a blast chamber 220 downstream of an expansion chamber, and wherein the blast chamber 220 is bounded by a first baffle and a second baffle.

In other embodiments, a suppressor is provided and includes a unitary structure containing a body having an interior volume and a cone shaped nozzle disposed at one end of the body, wherein the body includes a plurality of cooling channels spanning a length of the body, and a plurality of internal channels that is formed radially inward of the cooling channels, and both of the plurality of cooling channels and the plurality of internal channels terminating in a faceplate of the body, wherein the cone shaped nozzle includes a muzzle chamber at a muzzle end of the unitary structure, and wherein the unitary structure incudes a first portion including the muzzle chamber and a second portion including the interior volume, and a volumetric ratio of the interior volume relative to the muzzle chamber is about 85%:15%, a central bore formed from a breech end of the body to the faceplate, and a plurality of baffles surrounding the central bore, wherein a portion of the plurality of baffles defines a blast chamber bounded by a first baffle and a second baffle.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1A:
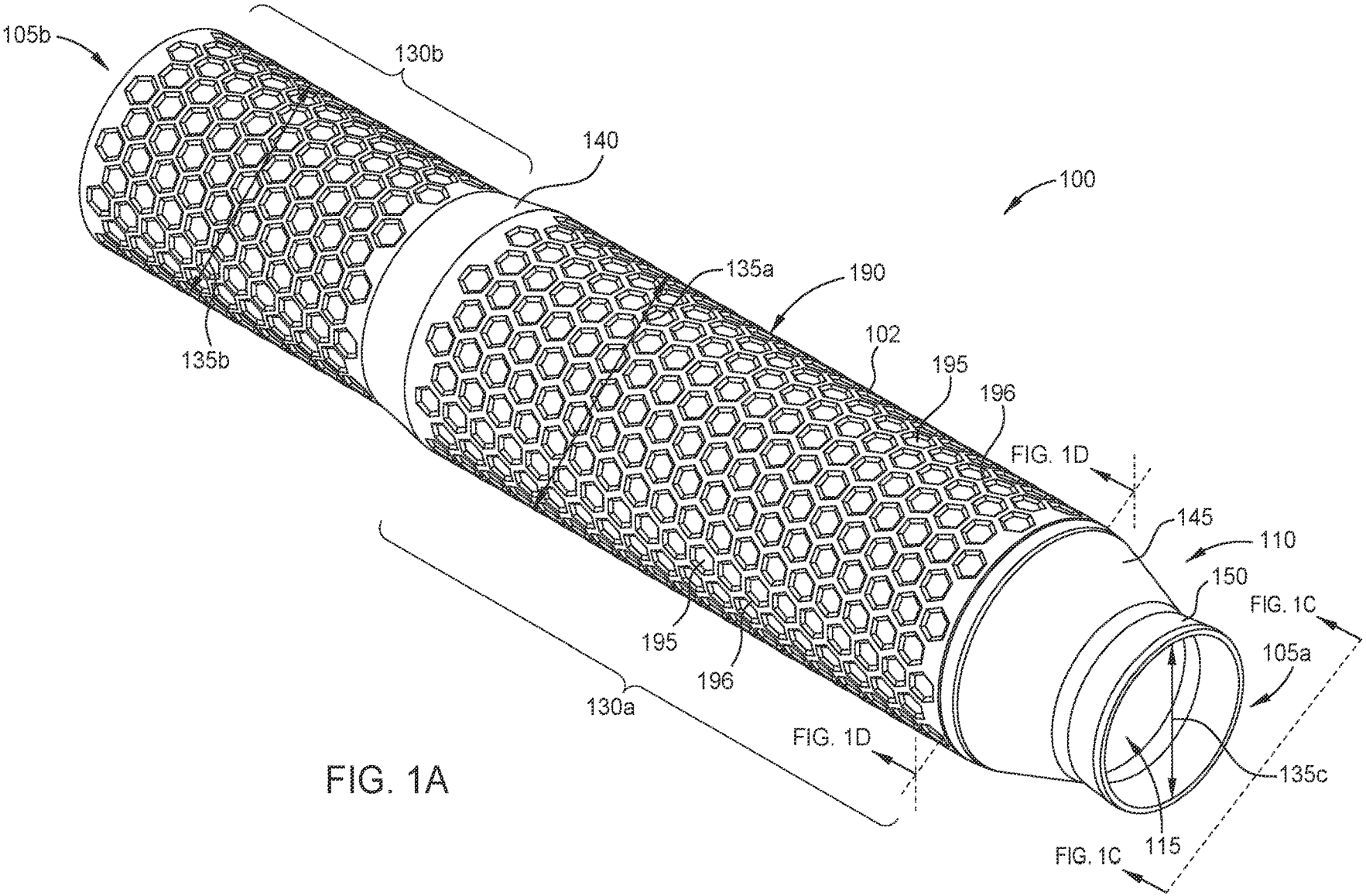
FIG. 1A depicts an isometric front view of a suppressor, according to one or more embodiments.

Embodiments described herein provide a firearm suppressor that minimizes sound, flash, and/or heat during and/or after use. Although the suppressor as described herein may be used with any type of firearm, the suppressor is specifically designed for semi-automatic firearms or select-fire firearms, for example firearms operating in a full automatic firing mode. Examples of firearms that the suppressor as described herein may be used with include machine guns such as M4A1 style firearms, M-16 style firearms, AR-10 style firearms, belt-fed style firearms, M-240 style firearms as well as other firearms configured to fire repeatedly without reloading after each round is fired.

One drawback of conventional suppressor designs is heat build-up during use. For example, suppressors are heated during the firing of a firearm to temperatures in a range from about 1,200° F. to about 1,500° F., or greater. This produces a safety hazard to humans from burns, melting of base metals used in the construction of the conventional suppressors, damage or weakening of welds (or other joints used in the construction of the conventional suppressors), or other damage that may cause the suppressor to fail. Even after firing has ceased, the conventional suppressors may take hours to cool to a temperature where a user could safely handle the suppressor.

Embodiments of the suppressor as described herein includes unique heat dissipating features which minimizes heat accumulation during use as compared to conventional suppressors. Embodiments of the heat dissipating features described herein also facilitates enhanced cooling after firing as compared to conventional suppressors. In one or more examples, the suppressor as described herein, after sustained firing over a short period of time, may be cooled to a temperature that allows safe handling in about 30 minutes. Additionally, embodiments of the suppressor as described herein includes a construction which provides enhanced structural rigidity and/or lifetime when used with modern select-fire firearms at high firing rates.

Fundamental to the benefits of the suppressor as described herein is the mode of manufacture. Unlike conventional suppressor manufacturing, additive manufacturing (3D printing) allows each layer to fuse together at all points of surface contact, instead of weld points, adding a structural rigidity traditional manufacturers are unable to achieve. Additive manufacturing allows several factors not available in conventional manufacturing methods. For example, additive manufacturing allows design that is not limited by traditional cutting tools. Additive manufacturing also allows for a monolithic suppressor as opposed to multiple components. This increases surface contact between the structural layers, as opposed to a single weld point or a threaded connection. Each layer is monolithic to the next on every contacted surface, which vastly increases structural integrity and overall durability of the suppressor. Thus, the suppressor as described herein is a single (unitary) structure. The terms "single" and/or "unitary" may be defined as having the indivisible character of a unit (e.g., whole or monolithic). The terms "single", "monolithic", and/or "unitary" are differentiated from conventional suppressors that include modular or discrete components that are welded, threaded, and/or otherwise joined together.

Materials for the suppressor as described herein include metals adapted for high temperature applications that retain structural properties and strength at elevated temperatures as well as heat dissipating qualities. In one or more embodiments, the suppressors and/or unitary structures thereof are also formed from one or more metals distributed or produced during 3D printing. The suppressors and/or unitary structures thereof can be made of, contain, or otherwise include one or more metals, such as titanium, one or more titanium alloys, aluminum, one or more aluminum alloys, nickel, one or more nickel superalloys, one or more nickel-aluminum alloys, iron, steel, one or more stainless steels, cobalt, chromium, molybdenum, one or more Inconel alloys, one or more Hastelloy alloys, one or more Invar alloys, one or more Inovoco alloys, CMSX® superalloys (e.g., CMSX®-2, CMSX®-4, CMSX®-4+, or CMSX®-10 superalloys, commercially from Cannon-Muskegon Corporation), alloys thereof, or any combination thereof. In one or more embodiments, the suppressors and/or unitary structures thereof can be made of, contain, or otherwise include one or more oxide dispersion strengthened (ODS) alloys, such as the GRX-810 alloy. In some examples, the ODS alloy contains at least nickel, cobalt, and chromium. In other examples, the ODS alloy contains about 30 weight percent (wt %) to about 36 wt % of nickel, about 30 wt % to about 36 wt % of cobalt, and about 30 wt % to about 36 wt % of chromium.

In one or more examples, the suppressors and/or unitary structures thereof can be made of, consist of, consist essentially of, comprise, contain, or otherwise include nickel or one or more nickel alloys. For example, the suppressors and/or unitary structures as described and discussed herein contain a nickel alloy having greater than wt % of nickel. In some examples, the suppressors and/or unitary structures as described and discussed herein contain about 57 wt % of nickel and about 10 wt % of cobalt.

In one or more examples, the suppressors and/or unitary structures thereof can be made of, consist of, consist essentially of, comprise, contain, or otherwise include titanium or one or more titanium alloys. In some embodiments, the titanium alloy contains titanium and one, two, three, or more of aluminum, tin, zirconium, molybdenum, silicon, neodymium, alloys thereof, or any combination thereof. In one or more examples, the titanium alloy contains about 78 wt % to about 92 wt % of titanium, about 4 wt % to about 8 wt % of aluminum, about 3 wt % to about 7% of tin, about 1 wt % to about 3 wt % of zirconium, about 0.4 wt % to about 2 wt % of molybdenum, about 0.1 wt % to about 0.7 wt % of silicon, and about 0.3 wt % to about 1.5 wt % of neodymium. In other examples, the titanium alloy contains about 80 wt % to about 90 wt % of titanium, about 5 wt % to about 7 wt % of aluminum, about 4 wt % to about 6% of tin, about 1.2 wt % to about 2.6 wt % of zirconium, about 0.5 wt % to about 1.8 wt % of molybdenum, about 0.2 wt % to about 0.6 wt % of silicon, and about 0.5 wt % to about 1.3 wt % of neodymium. In some examples, the titanium alloy contains about 83 wt % to about 87 wt % of titanium, about wt % to about 6.2 wt % of aluminum, about 4.4 wt % to about 5.2% of tin, about 1.8 wt % to about 2.2 wt % of zirconium, about 0.8 wt % to about 1.2 wt % of molybdenum, about 0.27 wt % to about 0.4 wt % of silicon, and about 0.6 wt % to about 1 wt % of neodymium. In one or more examples, the titanium alloy can be or include Ti60 alloy and contains about 85.55 wt % of titanium, about 5.6 wt % of aluminum, about 4.8% of tin, about 2 wt % of zirconium, about 1 wt % of molybdenum, about 0.35 wt % of silicon, and about 0.7 wt % of neodymium.

In addition, while traditional suppressors are effectively sealed and limited to exhausting hot gases through a central bore (where a projectile (e.g., bullet) passes through the suppressor), the suppressor as described herein is vented. In particular, the suppressor as described herein is a forward venturi suppressor as all gases are exhausted via an enlarged opening at the muzzle end (through a nozzle and/or a muzzle chamber formed outside of the structural frame) of the suppressor. While the structural frame is effectively sealed, there are multiple channels formed therein that differentiate the construction of the suppressor as described herein when compared to conventional suppressors. Thus, the enlarged opening at the muzzle end, which is integral to the suppressor, allows more volume for gases to be exhausted as compared to conventional suppressors.

Figure 1B:
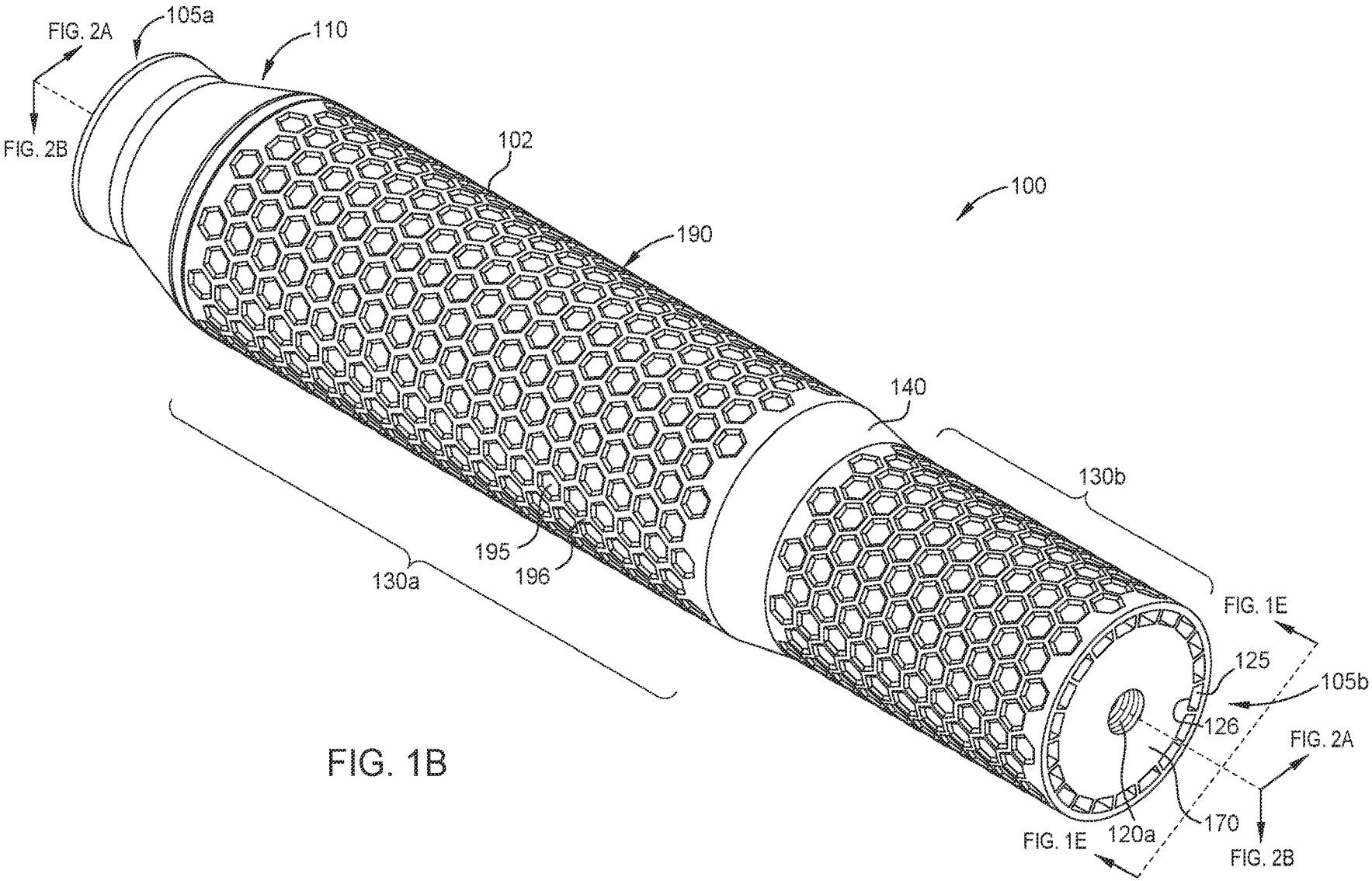
FIG. 1B depicts an isometric rear view of the suppressor illustrated in FIG. 1A, according to one or more embodiments.

FIG. 1A is an isometric front view of a suppressor 100 according to one or more embodiments described and discussed herein. FIG. 1B is an isometric rear view of the suppressor 100 of FIG. 1A. The suppressor 100 is a unitary structure which includes an elongated body 102 having a muzzle end 105*a* and a breech end 105*b* opposite to the muzzle end 105*a*. The muzzle end 105*a* includes a cone shaped nozzle 110 that is external to the elongated body 102. The cone shaped nozzle 110 extends from the elongated body 102 housing or circumscribing a muzzle chamber 115. The cone shaped nozzle 110 resembles a truncated cone. The cone shaped nozzle 110 and the muzzle chamber 115 form part of a venturi nozzle that is an integral part of the suppressor 100.

As shown in FIG. 1B, the breech end 105*b* includes an opening 120*a* that defines a portion of internal bore, such as a central bore 203 (illustrated in FIG. 2A), extending through the elongated body 102. At least a portion of the opening 120*a* at the breech end 105*b* includes a coupling device, such as threads, for coupling with or otherwise attaching to a barrel of a firearm (not shown). When coupled to a firearm, a projectile exiting the barrel enters the opening 120*a*, passes through the central bore 203 within the elongated body 102, and exits out of an opening 120*b* in the muzzle end 105*a*.

The breech end 105*b* also includes a plurality of cooling channels 125 that extends through the elongated body 102. The cooling channels 125 are in fluid communication with ambient air at the breech end 105*b* and extend through the elongated body 102 to the muzzle chamber 115. Each of the cooling channels 125 has a first opening 126 at the breech end 105*b* and a second opening 128 at the faceplate 165. The ambient air is the ambient gases surrounding the outside of the suppressor 100 and excludes the hot gases produced or otherwise generated by discharging a projectile (e.g., bullet) from a cartridge. The ambient air is at a lower temperature than the hot gases generated from the cartridge and passing through the central bore 203 and the cooling channels 125.

In some embodiments, the elongated body 102 includes a first section 130*a* and a second section 130*b*, as depicted in FIGS. 1A-1B. The first section 130*a* includes a first diameter 135*a* and the second section 130*b* includes a second diameter 135*b*. The first diameter 135*a* is greater than the second diameter 135*b*. The reduced second diameter 135*b* of the second section 130*b* can be utilized to allow the suppressor 100 to fit within a handguard (not shown) that is typically utilized on conventional firearms. The enlarged first diameter 135*a* of the first section 130*a* is provided to maximize an internal volume of the elongated body 102. A transition region 140 is provided as an interface between the first section 130*a* and the second section 130*b*. In some embodiments, the enlarged first diameter 135*a* provides additional internal volume for internal channels 160 (shown and described in FIGS. 1C-1D and 2A-2B).

The cone shaped nozzle 110 includes an inwardly angled outer sidewall 145 transitioning from the first diameter 135*a* to an annular ring section 150. The annular ring section 150 includes a diameter (e.g., third diameter 135*c*) that is less than the first diameter 135*a* and the second diameter 135*b*. Thus, the geometry of the cone shaped nozzle 110 provides a constriction for gas (e.g., air and/or hot gases) as a projectile exits the muzzle end 105*a* of the suppressor 100.

The operation of the suppressor 100 is further explained in more detail as follows. When a projectile is fired through the suppressor 100 and passes through the muzzle end 105*a* of the suppressor 100, a high-pressure gas/atmosphere and a shock wave are produced inside the muzzle chamber 115 of the cone shaped nozzle 110. The high-pressure gas/atmosphere inside the muzzle chamber 115 and the low pressure outside the suppressor 100 causes a Venturi-effect which pulls ambient air from the breech end 105*b* through the flow channels 125 and the elongated body 102. The ambient air passes over and/or through portions of the elongated body 102 removing heat from the elongated body 102 and other portions/parts of the suppressor 100. The heated air then exits into the muzzle chamber 115 and out of the muzzle end 105*a* of the suppressor 100.

In one or more examples, a Venturi-effect produced by the suppressor 100 causes fluid flow velocity to increase as the gases passes through a constriction provided by the geometry of the cone shaped nozzle 110 (e.g., the third diameter 135*c*), while the fluid's static pressure is decreased. Since the fluid molecules are flowing faster in the constriction, the pressure in the constriction (e.g., the muzzle chamber 115) should be lower than it is outside of the constriction. In order for the fluid molecules to speed up as they enter the constriction, and then slow down again as they leave the constriction, there must be a pressure difference at the entrance and exit of the constriction. When the velocity of the fluid increases, the fluid moves from greater pressure to lower pressure regions. As the fluid flows horizontally, the greatest speed occurs where the pressure is the lowest. The low-pressure ambient air at the muzzle end 105*a* of the suppressor 100 is moved into the channels 125 and rapidly across and/or through the elongated body 102 thus cooling the suppressor 100, reducing sound signature, reducing thermal signature, reducing flash signature, and/or extending operational life.

In some embodiments, as shown in FIGS. 1A-1B, the suppressor 100 includes a coating 190 disposed on the outer surface of the elongated body 102. The coating 190 effectively manages the visual and near-infrared (NIR) signature while at the same time enhancing thermal protection and durability. The coating 190 is applied to the suppressor 100 and allowed to cure until the coating 190 reaches a desired hardness and has desired chemical and physical properties. The coating 190 has a Wolff-Wilbourn (Pencil Hardness) test rating (ASTM D3363) of 9 h+, the highest hardness rating. Once cured the coating 190 has no odor, is RoHS and REACH compliant, and conforms to NIR reflectivity standards outlined in MIL-DTL-44436. In some embodiments, the elongated body 102 and/or the coating 190 includes a plurality of polygonal structures 195 having a plurality of raised sides 196. The polygonal structures 195 may be hexagons (e.g., having a hexagonal shape) as shown in FIGS. 1A-1B, or may be octagons, heptagons, pentagons, rectangles, squares, triangles (e.g., having a triangular shape), other polygons, other geometric shapes, or any combination or mixture thereof. The polygonal structures 195 increase the surface area of the elongated body 102, which enhances heat transfer for cooling the suppressor 100.

Under extreme temperatures, the coating 190 has been observed to change colors, as if to burn away (e.g., during extreme torture testing). However, upon cooling, the coating 190 restores to its original color and leaves no indication, as determined through outwardly visual or thermal/IR observations, of any deterioration of its protective or thermal/IR mitigating properties. The coating 190 retains effective thermal/IR mitigating properties even at elevated temperatures. Other coatings that were tested would deteriorate over time thus reducing their effectiveness. The coating 190 can also be mixed in any color combination desired for any application.

Figure 1C:
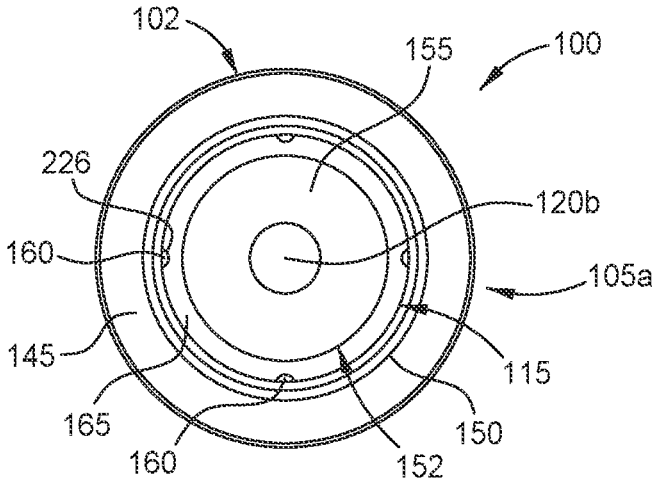
FIG. 1C depicts a front view of the suppressor along lines 1C-1C illustrated in FIG. 1A, according to one or more embodiments.
Figure 1D:
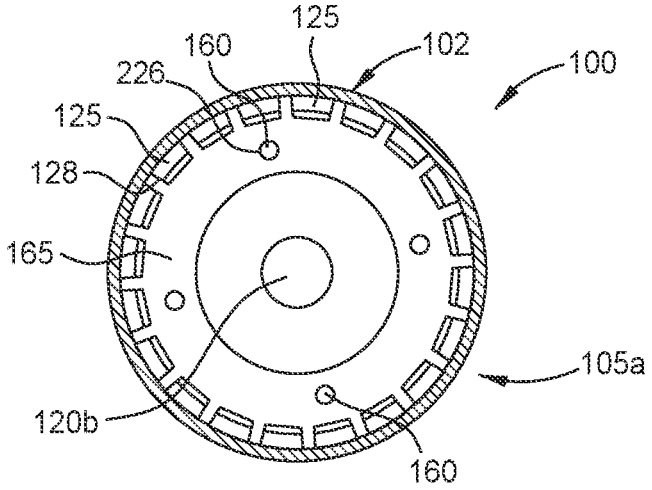
FIG. 1D depicts a partial sectional view of the suppressor along lines 1D-1D illustrated in FIG. 1A, according to one or more embodiments.
Figure 1E:
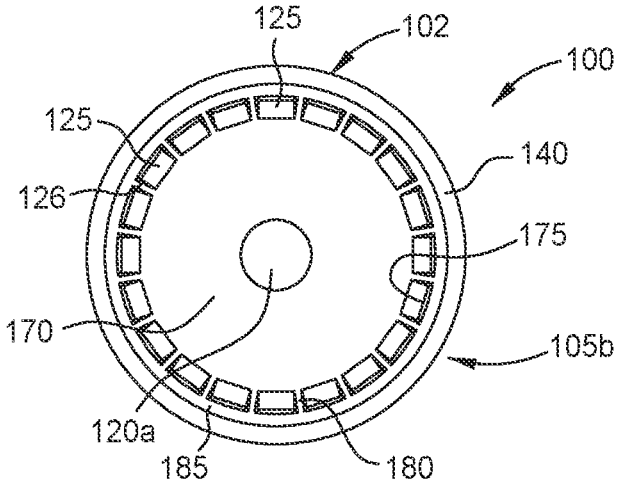
FIG. 1E depicts a rear view of the suppressor along lines 1E-1E illustrated in FIG. 1B, according to one or more embodiments.

FIGS. 1C-1E are various views of the suppressor 100. FIG. 1C is a front view of the suppressor 100 along lines 1C-1C of FIG. 1A (the muzzle end 105*a*). FIG. 1D is a partial sectional view of the suppressor 100 along lines 1D-1D of FIG. 1A. FIG. 1E is a rear view of the suppressor 100 along lines 1E-1E of FIG. 1B (the breech end 105*b*).

As shown in FIG. 1C-1D, the suppressor 100 includes a venturi nozzle 152 formed at least in part by a volume defined by interior surfaces of the cone shaped nozzle 110 and a conical wall 155 inside the muzzle chamber 115. The conical wall 155 and the venturi nozzle 152 will be shown and described in more detail below.

The suppressor 100 also includes a plurality of internal channels 160 that is formed radially and/or longitudinally (lengthwise) inward of the cooling channels 125. Each of the internal channels 160 is formed in a faceplate 165 of the elongated body 102 and/or the muzzle chamber 115. While the cooling channels 125 extend from the breech end 105*b* of the suppressor 100 to the muzzle chamber 115, the internal channels 160 are in fluid communication with the opening 120 inside the elongated body 102 (near the transition region 140 of FIGS. 1A-1B) and extend to and are open to the muzzle chamber 115 at the muzzle end 105*a*. The internal channels 160 function to minimize over-pressurization of internal regions of the elongated body 102 and will be further discussed below. In one or more embodiments, as shown in FIGS. 1C-1E and 2A-2B, the plurality of cooling channels 125 and the plurality of internal channels 160 terminate in the faceplate 165. For example, each of the cooling channels 125 has a first opening at the breech end 105*b*, such as the breech face 170, and a second opening at the faceplate 165. Each of the internal channels 160 has a first opening or port 224 in the interior volume 200 within the blast chamber 220 and a second opening 226 in the faceplate 165.

As shown in FIG. 1E, the plurality of cooling channels 125 is shown in a breech face 170 of the elongated body 102. Each of the cooling channels 125 includes an internal surface 175 and each cooling channel 125 is separated from one another by a radially oriented wall 180. Each of the radially oriented walls 180 is coupled to an outer ring 185. In use, the cooling channels 125 are an effective heat sink. For example, when a projectile is fired through the suppressor 100, the internal surfaces 175, the radially oriented walls 180, and the outer ring 185 conduct and transfer heat. Ambient air which flows through the cooling channels 125 enters the breech end 105*b* and flows along the internal surfaces 175, the radially oriented walls 180, and the outer ring 185 (based on the Venturi-effect described above). The ambient air absorbs the heat from the internal surfaces 175, the radially oriented walls 180, and the outer ring 185 and in turn, the heated ambient air flows out of the cooling channels 125 and effectively removes heat from the elongated body 102 and away from the suppressor 100.

Figure 2A:
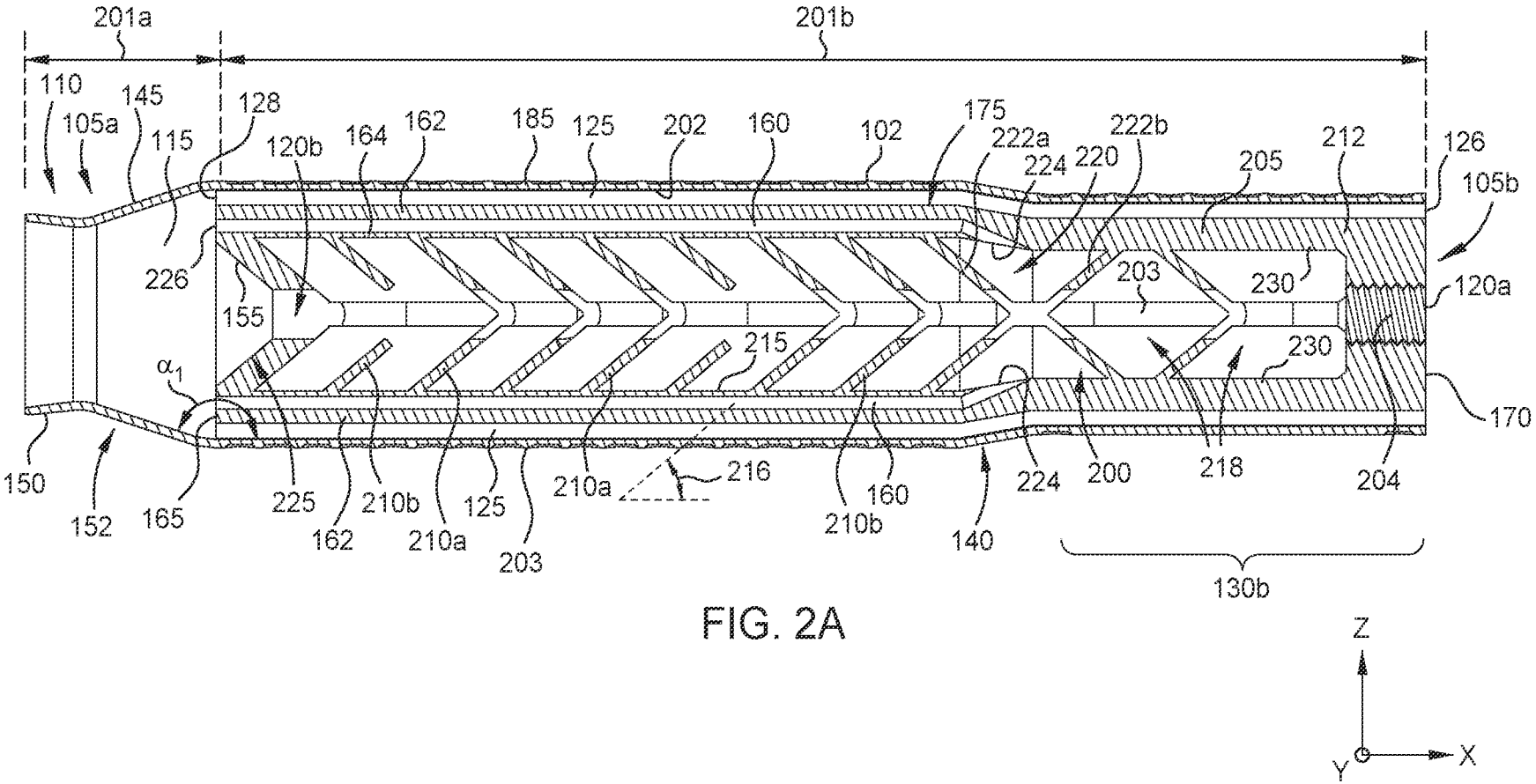
FIGS. 2A-2B depict sectional side views of the suppressor along lines 2A-2A and 2B-2B of FIG. 1B, respectively, according to one or more embodiments.
Figure 2B:
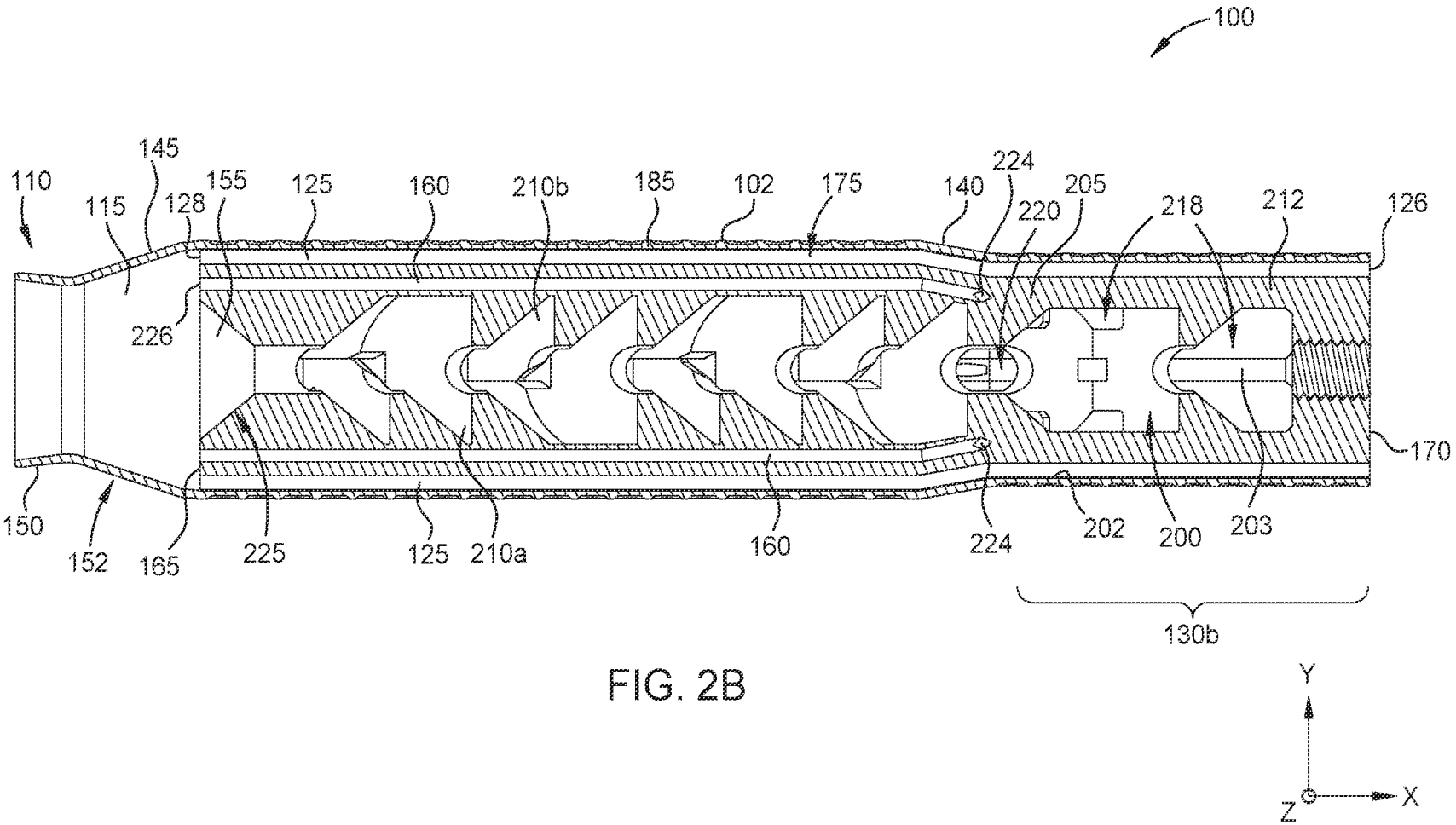

FIGS. 2A-2B depict sectional side views of the suppressor 100 along lines 2A-2A and 2B-2B, respectively, of FIG. 1B. The internal channels 160 and the cooling channels 125 extend within the suppressor 100 and are radially outside of an internal volume 200 of the suppressor 100, as depicted in FIGS. 2A-2B. The plurality of cooling channels 125 is radially separated from the plurality of internal channels 160 by an outer longitudinal wall 162 (shown in FIG. 2A) that is part of a primary structural frame 205. The plurality of internal channels 160 is at least partially separated from the internal volume 200 by an inner longitudinal wall 164 (shown in FIG. 2A) that is part of the structural frame 205.

In one or more embodiments, the suppressor 100 includes a first portion 201*a* and a second portion 201*b*. The first portion 201*a* includes the venturi nozzle 152 and the muzzle chamber 115. The second portion 201*b* includes the remainder of the elongated body 102 of the suppressor 100, as well as the internal volume 200. In some embodiments, a ratio of the empty volume of the internal volume 200 (e.g., between a cover layer 202 surrounding an inner periphery of the elongated body 102 and adjacent to any solid portions within the inside surface of the cover layer 202) to the volume of the muzzle chamber 115 is about 85%:15%. The term "about" in this context means +/−3%. In some embodiments, such as for an M-240 firearm, the internal volume 200 is about 16 cubic inches to about 18 cubic inches, or about 17 cubic inches to about 17.8 cubic inches, for example about 17.5 cubic inches. In contrast, the volume of the venturi nozzle 152 (or muzzle chamber 115) is about 2.8 cubic inches to about 3.2 cubic inches, for example about 3 cubic inches. The term "about" in this context means +/−0.2 cubic inches. Thus, a ratio of the volume of the internal volume 200 relative to the volume of the muzzle chamber 115 is 5.8:1 in some embodiments. In other embodiments, such as for an M-249 firearm, the volumes described above may be reduced by 15%. In other examples, the internal volume 200 is about 12 cubic inches to about 22 cubic inches, about 14 cubic inches to about 20 cubic inches, about 16 cubic inches to about 18 cubic inches, or about 17 cubic inches to about 17.8 cubic inches, for example about 17.5 cubic inches.

The central bore 203, sized to allow a projectile to pass therethrough, is shown along a length of the elongated body 102. Threads 204 are shown in the opening 120 of the breech face 170. The threads 204 are used to couple or otherwise attach the suppressor 100 to a barrel of a firearm (not shown).

The internal volume 200 includes the primary structural frame 205 providing a majority of the rigidity of the elongated body 102. The structural frame 205 includes a varying cross-section along a length of the elongated body 102. The structural frame 205 includes a plurality of baffles shown as full baffles 210*a* and partial baffles 210*b*. Each of the full baffles 210*a* and the partial baffles 210*b* extend from an internal surface 215 of the internal volume 200 at an angle 216 relative to horizontal (e.g., the Y-X plane). The angle 216 is substantially orthogonal (e.g., 45°+/−5°). The full baffles 210*a* and the partial baffles 210*b* differ in length (the partial baffles 210*b* having a length less than a length of the full baffles 210*a*). In some embodiments, the partial baffles 210*b* are provided in order to increase the volume of the internal volume 200. Additionally or alternatively, the partial baffles 210*b* serve to disrupt gas flow within the internal volume 200, which aids in reducing sound levels when firing a projectile through the suppressor 100.

A portion of the structural frame 205 within the second section 130*b* of the elongated body 102 contains a heat sink 212. The heat sink 212, generally located at the breech end 105*b* where temperatures may be the greatest during firing of a projectile, absorbs at least a portion of the thermal energy from the firing of the projectile via conduction, convection and/or radiation. The heat sink 212 transfers the thermal energy to ambient air via the cooling channels 125 using the Venturi-effect from the venturi nozzle 152 (or muzzle chamber 115) when a projectile is fired.

During use of the suppressor 100, a fired projectile passes through the suppressor 100 from the breech end 105*b* to the muzzle end 105*a* via the opening 120*a*, the central bore 203, and the opening 120*b*. The hot gases derived from the cartridge of the projectile enters the central bore 203 from the opening 120*a* and enters the plurality of internal channels 160 from the first opening or port 224. The hot gases flow through the central bore 203 and the plurality of internal channels 160 and exit into the muzzle chamber 115. As the hot gases pass through the muzzle chamber 115, the Venturi-effect is produced by the hot gases which pull the ambient air through the first openings 126, along the cooling channels 125, and out of the second openings 128. The hot gasses and the ambient air combine in the muzzle chamber 115 and exit the suppressor 100 at the breech end 105*b*.

In one or more embodiments, the interface of the elongated body 102 and the cone shaped nozzle 110 form a venturi angle $\alpha_1$ facing inward into the internal volume 200, as depicted in FIG. 2A. It has been a surprising and unexpected discovery that a desired range in the value of the venturi angle $\alpha_1$ provides enhanced results via the Venturi-effect to maximize the flowrate of the ambient air through the cooling channels 125 during use of the suppressor 100. As such, the suppressor 100 has a reduction in heat (e.g., stays cooler during use), as well as provides a reduction in sound audible and a reduction in flash at the muzzle, such as at the annular ring section 150. The venturi angle $\alpha_1$ can have a value of about 140°, about 150°, about 152°, about 155°, about 156°, about 157°, about 158°, about 159°, or about 160° to about 161°, about 162°, about 163°, about 163°, about 165°, about 166°, about 168°, about 170°, about 172°, about 174°, or about 175°. For example, the venturi angle $\alpha_1$ can have a value in a range from about 140° to about 175°, about 145° to about 175°, about 148° to about 175°, about 150° to about 175°, about 152° to about 175°, about 155° to about 175°, about 158° to about 175°, about 160° to about 175°, about 162° to about 175°, about 165° to about 175°, about 140° to about 170°, about 145° to about 170°, about 148° to about 170°, about 150° to about 170°, about 152° to about 170°, about 155° to about 170°, about 158° to about 170°, about 160° to about 170°, about 162° to about 170°, about 165° to about 170°, about 140° to about 168°, about 145° to about 168°, about 148° to about 168°, about 150° to about 168°, about 152° to about 168°, about 155° to about 168°, about 158° to about 168°, about 160° to about 168°, about 162° to about 168°, about 165° to about 168°, about 140° to about 165°, about 145° to about 165°, about 148° to about 165°, about 150° to about 165°, about 152° to about 165°, about 155° to about 165°, about 158° to about 165°, about 160° to about 165°, about 162° to about 165°, or about 163° to about 165°.

The internal volume 200 also includes one or more expansion chambers 218 located at the breech end 105*b* of the elongated body 102. The expansion chambers 218 at least partially contain the initial blast of hot and/or expanding gases when a projectile is fired into the suppressor 100. The expansion chambers 218 lead to a blast chamber 220 downstream of the expansion chambers 218. The blast chamber 220 is bounded by a pair of first baffles 222*a* and a pair of second baffles 222*b*. The first baffles 222*a* and the second baffles 222*b* are full baffles 210*a*. The first baffles 222*a* and the second baffles 222*b* differ in the angular and/or directional orientation in the internal volume 200 relative to the internal surface 215 and/or the elongated body 102. The first baffles 222*a* are oriented rearward (toward the breech end 105*b*) similar to other full baffles 210*a* (and partial baffles 210*b*). The second baffles 222*b* are oriented frontward at an angle opposite to the angle 216 (toward the muzzle end 105*a*). However, the angle of the second baffles 222*b* may be the same as the angle 216.

As mentioned above, the internal channels 160 are inside the elongated body 102 and are disposed radially inward of the cooling channels 125. The length of each internal channel 160 is less than the length of each cooling channel 125. The internal channels 160 may be referred to as "redirect nozzles". Each of the internal channels 160 have the first opening or port 224 that is positioned adjacent to, and/or is in fluid communication with, the blast chamber 220. As a projectile is fired, the blast chamber 220 fills with high pressure/high heat gasses. When the gasses reach the blast chamber 220, a portion of the gasses are redirected through the first opening or port 224. This allows a portion of the gasses to pass into the internal channels 160. By allowing gasses to free flow out of the internal volume 200, blast chamber 220, first openings or ports 224, and the internal channels 160, back pressures are significantly decreased while having less of an impact of the cyclic rate of the host weapon which reduces wear. Redirecting blast chamber gasses allows the highest temperature and pressure gasses to move unimpeded directly into the nozzle area, avoiding any disruption and minimizing heat loss. By redirecting the gasses directly into the nozzle from the blast chamber 220, the heat and high pressure increases the atmospheric pressure inside the muzzle chamber 115 of the cone shaped nozzle 110. The redirect nozzles (e.g., the internal channels 160) increase air speed over the cooling channels 125 by approximately 40%.

The internal volume 200 ends in a brake 225 formed in the elongated body 102. The brake 225 is integral to the elongated body 102 of the suppressor 100. The brake 225 includes the conical wall 155 and forms a portion of the venturi nozzle 152. In some embodiments, the brake 225 is utilized to redirect a portion of the propellant gases from a fired projectile to counter recoil in the firearm and/or "muzzle rise" which may interfere with accuracy of the firearm. Additionally or alternatively, the brake 225 redirects sound forward (toward the muzzle end 105*a*), away from the shooter of the firearm.

The structural frame 205 also includes a structural support member 230. The structural support member 230 generally spans a length of the elongated body 102 within the internal volume 200. A portion of the structural support member 230 is the baffles (e.g., the full baffles 210*a* and the partial baffles 210*b*).

Thermal Heat Transfer of the Suppressor

The suppressor 100 was tested for thermal heat transfer through stress testing and super heating the suppressor 100 to about 1,550° F. through a sustained fire regimes (two cycles) of 600 rounds of 147 gr 7.62×51 NATO ball ammunition. Temperature was measured at 60 second intervals during sustained fire over the two cycles using a Fluke® Infrared Thermometer Model 572-2 having a maximum operating temperature of 1,652° F. Ambient temperature of the suppressor 100 subsequent to firing was recorded at 144° F. Results of the testing is shown in Table 1.

TABLE 1

| Cycle | Minute | Temp (° F.) | Cycle | Minute | Temp (° F.) |
|---|---|---|---|---|---|
| 1 | 1 | 1565 | 2 | 1 | 1505 |
| | 2 | 1305 | | 2 | 1226 |
| | 3 | 1110 | | 3 | 1036 |
| | 4 | 938 | | 4 | 875 |
| | 5 | 820 | | 5 | 793 |
| | 6 | 750 | | 6 | 700 |
| | 7 | 647 | | 7 | 617 |
| | 8 | 581 | | 8 | 560 |
| | 9 | 522 | | 9 | 501 |
| | 10 | 484 | | 10 | 440 |
| | 11 | 441 | | 11 | 407 |
| | 12 | 403 | | 12 | 374 |
| | 13 | 373 | | 13 | 343 |
| | 14 | 344 | | 14 | 322 |
| | 15 | 315 | | 15 | 296 |
| | 16 | 295 | | 16 | 274 |
| | 17 | 275 | | 17 | 256 |
| | 18 | 252 | | 18 | 247 |
| | 19 | 244 | | 19 | 235 |
| | 20 | 227 | | 20 | 226 |
| | 21 | 212 | | 21 | 212 |
| | 22 | 206 | | 22 | 206 |
| | 23 | 195 | | 23 | 193 |
| | 24 | 188 | | 24 | 180 |
| | 25 | 182 | | 25 | 170 |
| | 26 | 171 | | 26 | 164 |
| | 27 | 161 | | 27 | 160 |
| | 28 | 152 | | 28 | 153 |
| | 29 | 145 | | 29 | 145 |
| | 30 | 144 | | 30 | 141 |

As shown above in the first cycle, a peak temperature of 1,565° F. was recorded upon completion of 600 rounds of sustained fire. At 10 minutes post firing, a temperature of 484° F. was recorded, which indicated a drop of 1,081° F. At 20 minutes post firing, a temperature of 227° F. was recorded, which indicated a drop of 1,338° F. After 30 minutes, the suppressor 100 had a temperature of 144° F., which indicates a drop of 1,421° F.

In conjunction with Texas A&M University, College Station, TX, Aeronautical Engineering department, an air volume test was conducted on the suppressor 100 for air speed and volume passing over the heat sink 212 and/or the cooling channels 125, which facilitates cooling the suppressor 100. The air speed and volume testing were performed using a HoldPeak® HP-866B anemometer coupled to the breech end 130B of the suppressor 100 via a 2.6" circular duct. Multiple 25 round cycles were fired in full-automatic mode and peak wind speed was determined in MPH.

Tested wind speed showed sustained 15.4 MPH through the suppressor 100. Using an air flow calculation through the 2.6" circular duct, a calculated 49.97 cubic feet/minute (CFM) is achieved through the cooling channels 125 of the suppressor 100 each time a projectile is fired. For perspective, a restroom exhaust fan produces 50 CFM of air flow. This enhanced air flow through the cooling channels 125 along the heat sink 212 is achieved using no moving mechanical parts in or on the suppressor 100.

Accuracy and Velocity

Accuracy and velocity of a host weapon using the suppressor 100 was tested using single round rate of fire through a chronograph.

Unsuppressed velocity resulted in 2,809 FPS (maximum) and 2,760 FPS (minimum). Using the same host weapon with the suppressor 100 as described herein resulted in 2,796 FPS (maximum) and 2,746 FPS (minimum). Velocity showed no negative impact using the suppressor 100 as described herein.

Accuracy was tested using single rounds in five round groups with each round loaded individually. The test host weapon used was full-automatic fire only rifle, causing the feed tray to be lifted each round. Five cycles of five rounds were performed suppressed and unsuppressed. Due to lifting the feed tray, optics 'zero' was compromised between shots, so the average of five cycles was used to determine minute of angle (MOA) variation. The test host weapon with the suppressor 100 as described herein averaged MOA of about 0.5 to about 1.0 better than the same test host weapon unsuppressed without the suppressor 100.

Extreme Torture Testing

Extreme torture testing was conducted using 600 round belts of full-automatic sustained fire, allowing cooling to ambient between firing schedules. Upon cooling, internal and external conditions were observed for any degradation and overall serviceability. External inspection was performed visually and internal inspection was performed using a borescope and endosnake digital camera. Temperature ranged per cycle from about 1,450° F. to about 1,550° F. at peak temperatures. Upon completion of 6 cycles of 600 rounds of full automatic sustained fire, no indications of internal or external excessive wear or damage was recorded.

Sound Reduction

The effective sound reduction was tested with an M-240 machine gun (host weapon) using a Larsen Davis LXT1-QPR firearms sound meter and was measured in decibels (dB). Baseline was determined using the Mil-Spec muzzle device provided with the M-240. Prior to testing, the sound meter was calibrated at 112 dB and ambient sound was measured to be 102 dB at the testing facility. The sound meter and muzzle were placed at 5 feet 2 inches from the ground using tripod stands. The sound meter was placed 6.56 feet left in line with the muzzle ("dB left" below) for one test and near the shooter's ear ("dB at shooters ear" below) for another test. The M-240 had the dB readings shown in Table 2.

TABLE 2

| Unsuppressed dB Left (baseline) | Suppressed dB Left |
|---|---|
| High: 159.8<br>Low: 158.9<br>Avg: 159.4 | High: 137.9<br>Low: 135.5<br>Avg: 137 |
| **Unsuppressed dB at Shooters Ear (baseline)** | **Suppressed dB at Shooters Ear** |
| High: 154.5<br>Low: 153.7<br>Avg: 153.9 | High: 138<br>Low: 135.4<br>Avg: 136.3 |

Figure 3A:
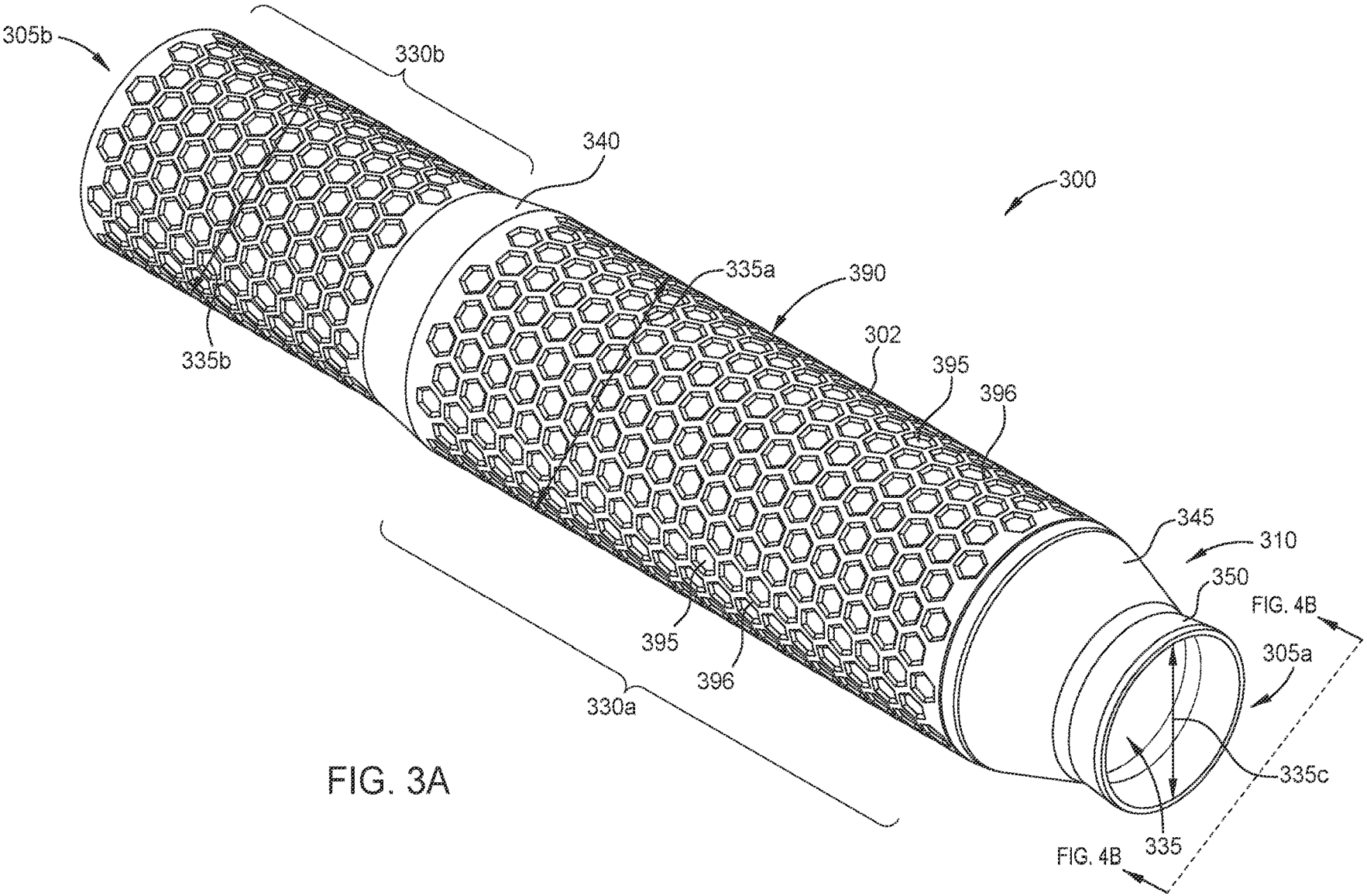
FIG. 3A depicts an isometric front view of another suppressor, according to one or more embodiments.
Figure 3B:
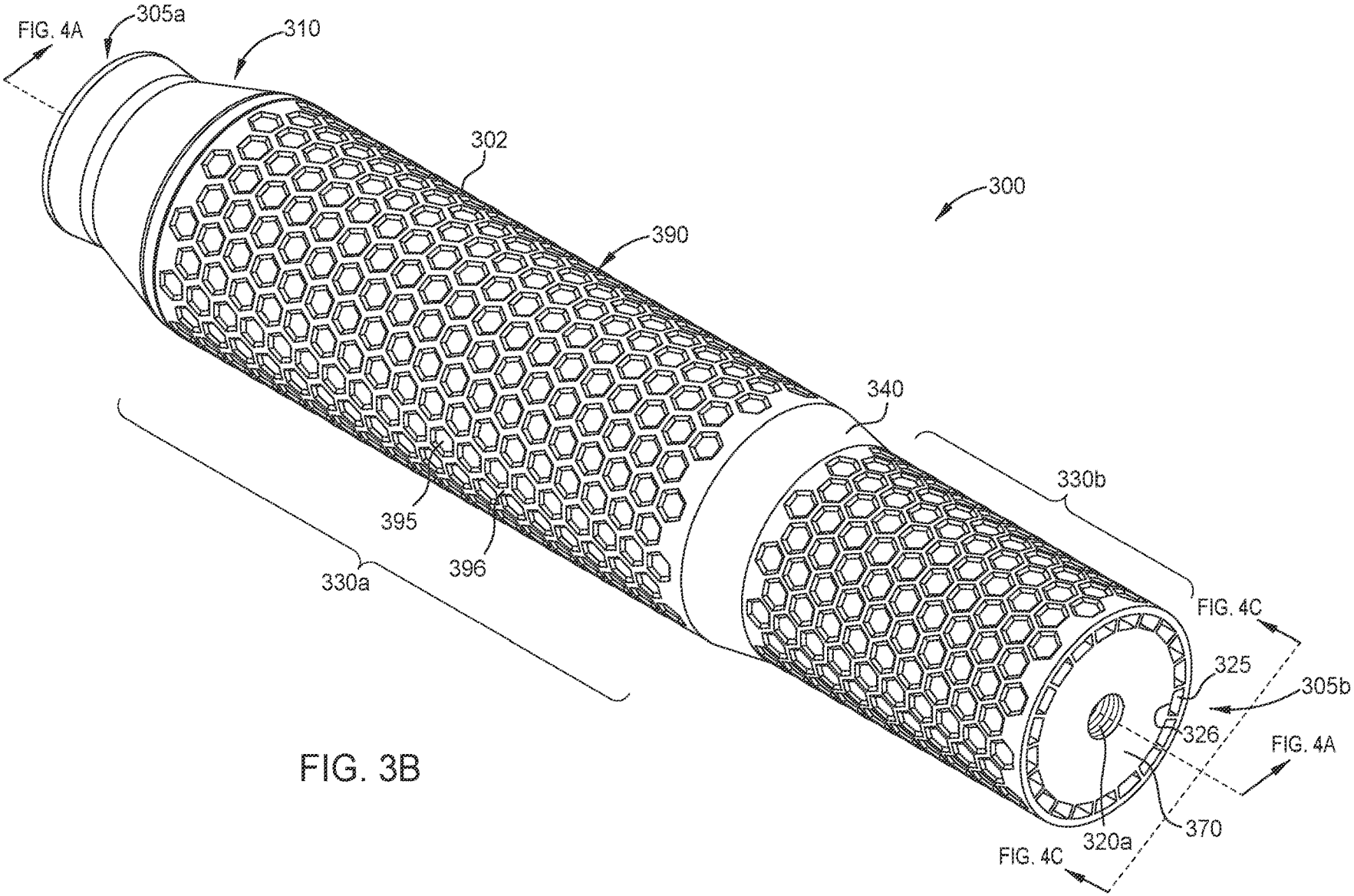
FIG. 3B depicts an isometric rear view of the suppressor illustrated in FIG. 3A, according to one or more embodiments.
Figure 4A:
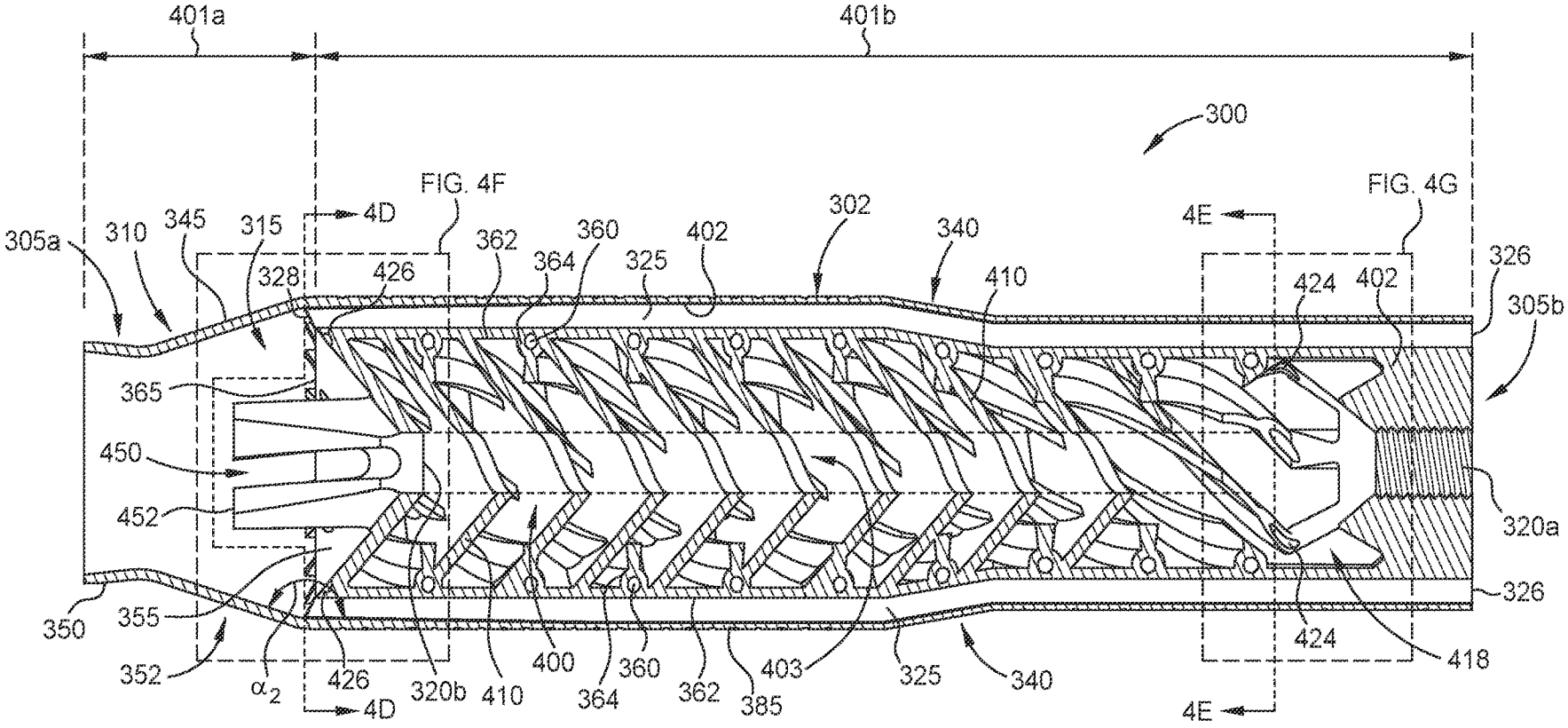
FIG. 4A depicts a cross-sectional view of the suppressor along lines 4A-4A illustrated in FIG. 3B, according to one or more embodiments.
Figure 4C:
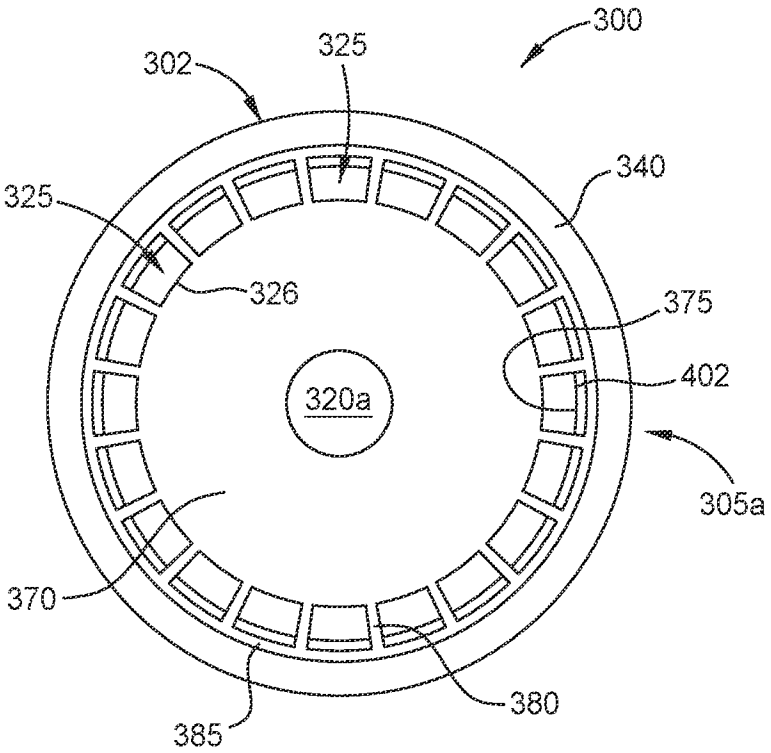
FIG. 4C depicts a rear view of the suppressor along lines 4C-4C illustrated in FIG. 3B, according to one or more embodiments.
Figure 4B:
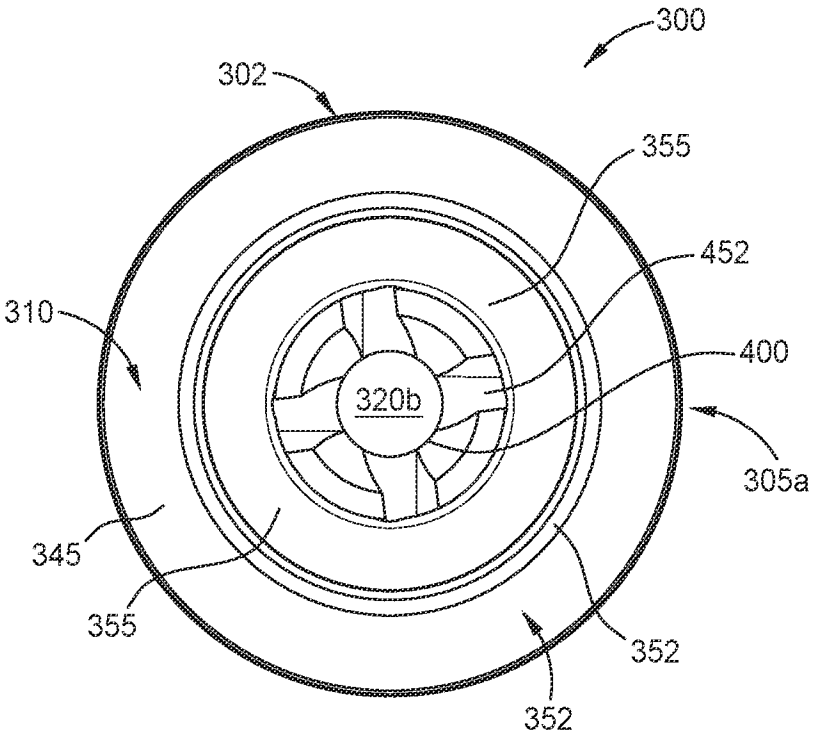
FIG. 4B depicts a front view of the suppressor along lines 4B-4B illustrated in FIG. 3A, according to one or more embodiments.
Figure 4E:
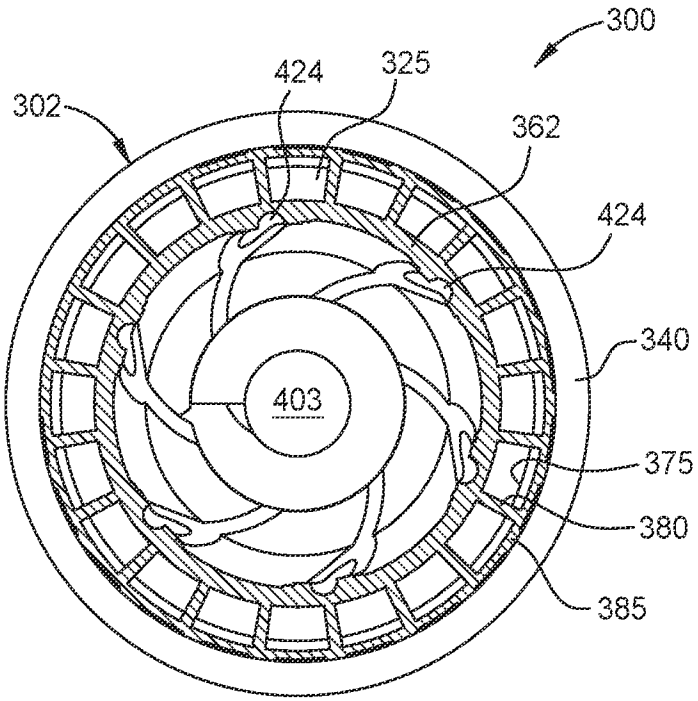
FIG. 4E depicts a partial sectional rear view of the suppressor along lines 4E-4E illustrated in FIG. 4A, according to one or more embodiments.
Figure 4D:
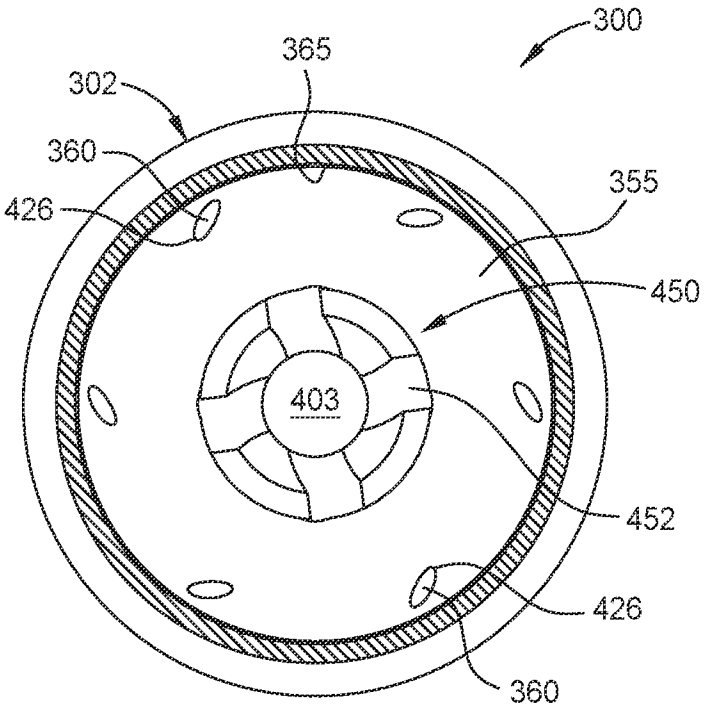
FIG. 4D depicts a partial sectional front view of the suppressor along lines 4D-4D illustrated in FIG. 4A, according to one or more embodiments.
Figure 4G:
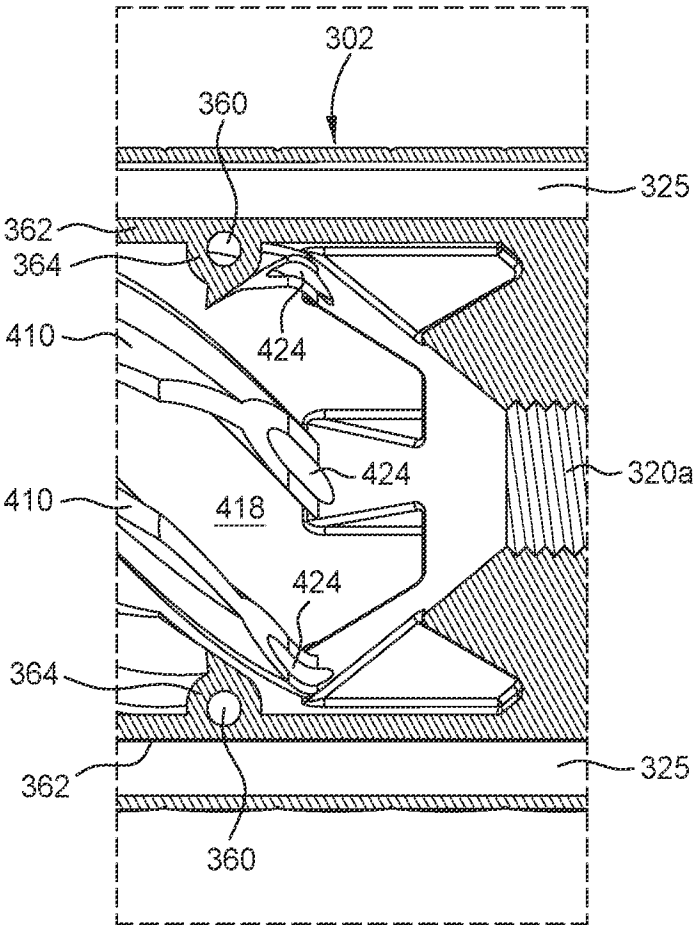
FIG. 4G depicts an enlarged sectional view near the rear of the suppressor within area 4G illustrated in FIG. 4A, according to one or more embodiments.
Figure 4F:
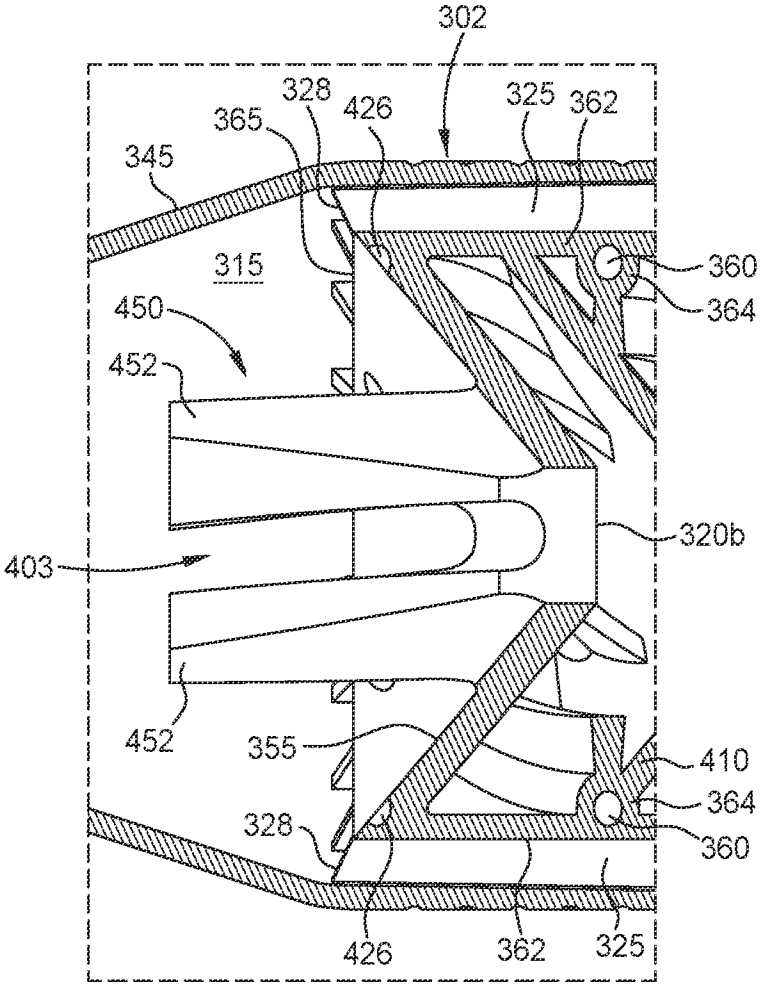
FIG. 4F depicts an enlarged sectional view near the front of the suppressor within area 4F illustrated in FIG. 4A, according to one or more embodiments.
Figure 5A:
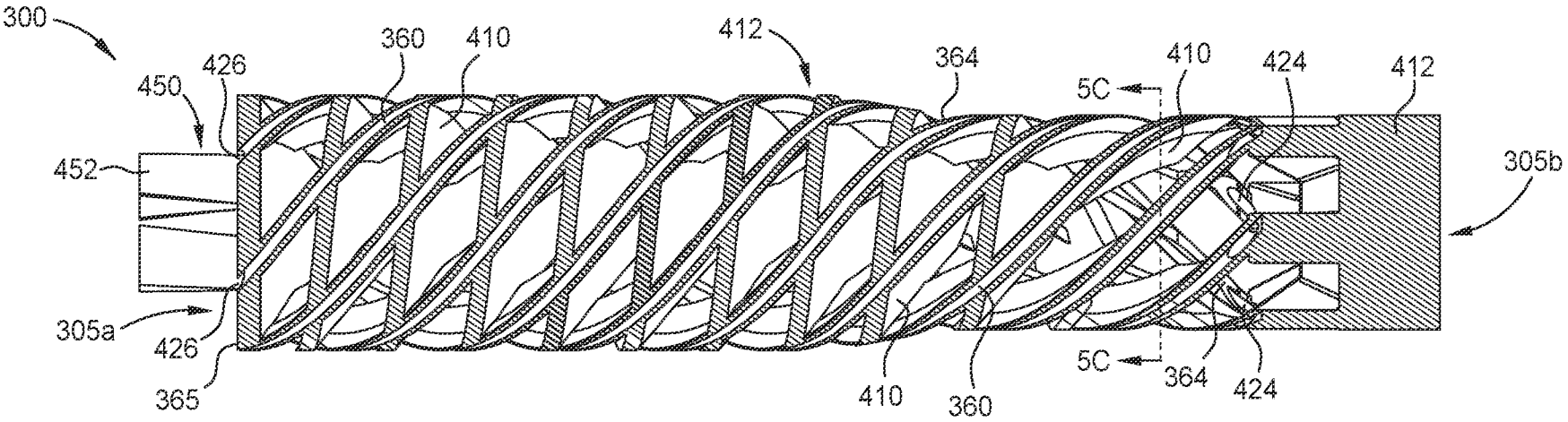
FIG. 5A depicts an isometric side view of a portion of the suppressor illustrated in FIG. 3A, shown in absence of at least most of an outer ring, according to one or more embodiments.
Figure 5B:
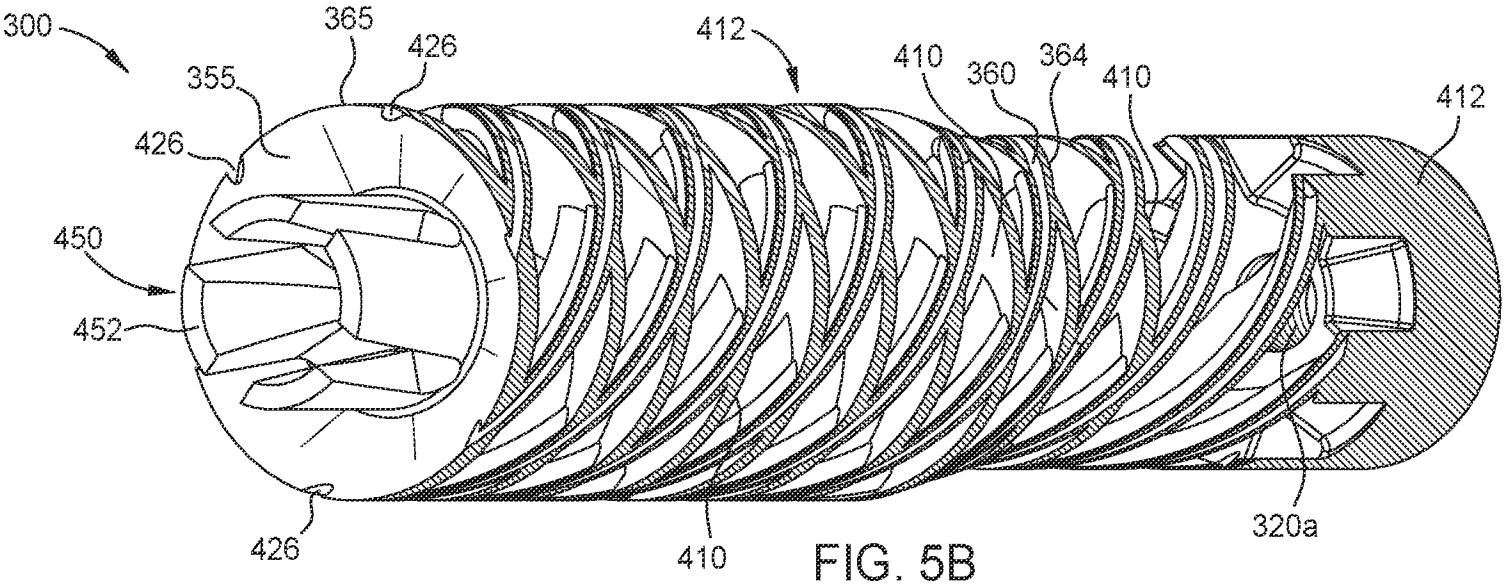
FIG. 5B depicts an isometric front view of the portion of the suppressor illustrated in FIG. 5A, according to one or more embodiments.
Figure 5C:
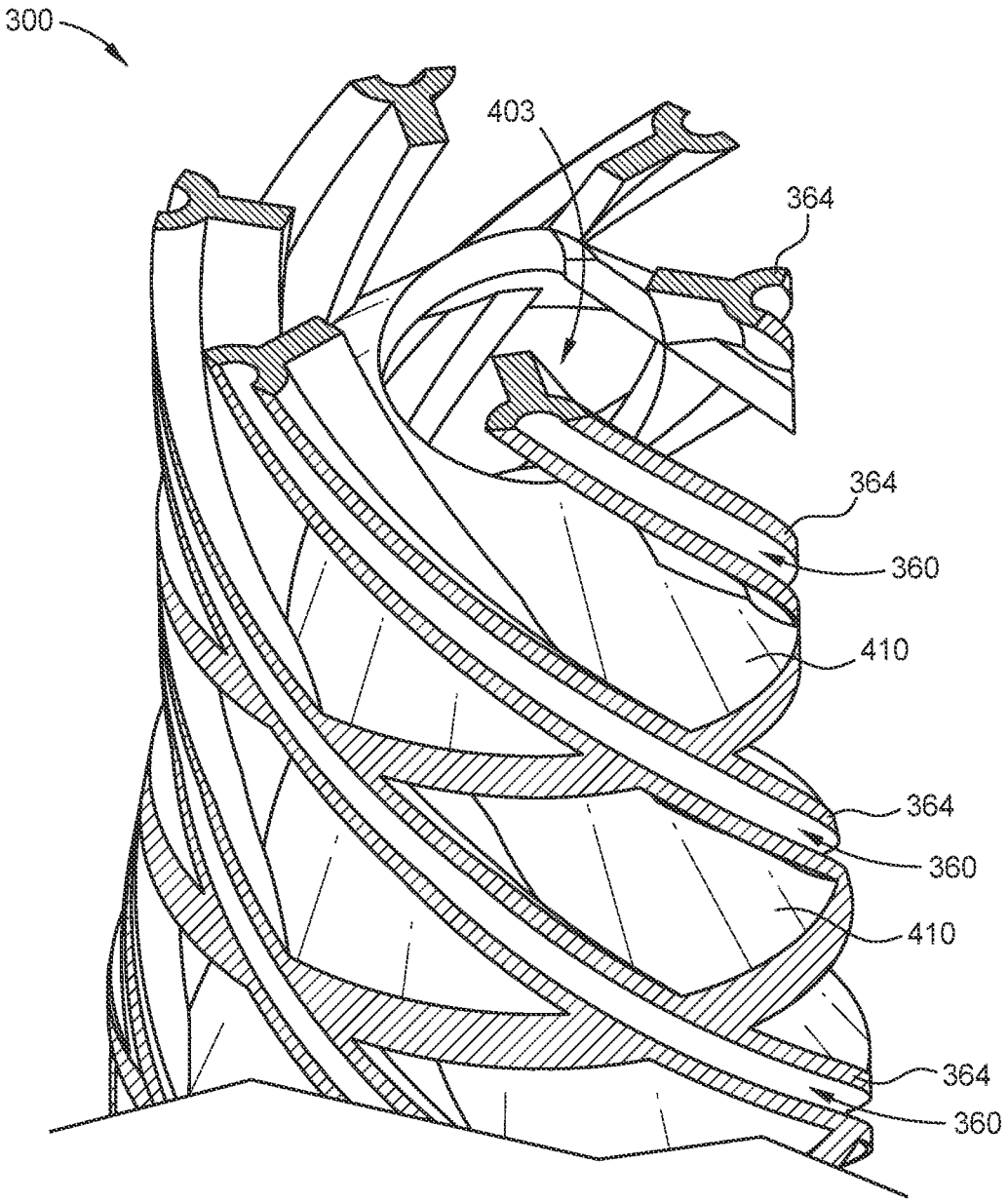
FIG. 5C depicts a partial view of the portion of the suppressor along lines 5A-5A illustrated in FIG. 5A, according to one or more embodiments.

FIG. 3A depicts an isometric front view of a suppressor 300 and FIG. 3B depicts an isometric rear view of the suppressor 300, according to one or more embodiments. FIGS. 4A-4G and 5A-5C also depict various views of the suppressor 300. FIG. 4A depicts a cross-sectional view of the suppressor 300 along lines 4A-4A illustrated in FIG. 3B, FIG. 4B depicts a front view of the suppressor 300 along lines 4B-4B illustrated in FIG. 3A, and FIG. 4C depicts a rear view of the suppressor along lines 4C-4C illustrated in FIG. 3B. FIG. 4D depicts a partial sectional front view of the suppressor along lines 4D-4D illustrated in FIG. 4A, FIG. 4E depicts a partial sectional rear view of the suppressor along lines 4E-4E illustrated in FIG. 4A, FIG. 4F depicts an enlarged sectional view near the front of the suppressor along lines 4F-4F illustrated in FIG. 4A, and FIG. 4G depicts an enlarged sectional view near the rear of the suppressor along lines 4E-4E illustrated in FIG. 4A. FIG. 5A depicts an isometric side view of a portion of the suppressor 300, shown in absence of at least most of an outer ring 385, FIG. 5B depicts an isometric front view of the portion of the suppressor 300 illustrated in FIG. 5A, and FIG. 5C depicts a partial view of another portion of the suppressor 300 along lines 5A-5A illustrated in FIG. 5A.

As shown in FIGS. 3A-3B, the suppressor 300 is a unitary structure which includes an elongated body 302 having a muzzle end 305*a* and a breech end 305*b* opposite to the muzzle end 305*a*. The muzzle end 305*a* includes a cone shaped nozzle 310 that is external to the elongated body 302. The cone shaped nozzle 310 extends from the elongated body 302 housing or circumscribing a muzzle chamber 315. The cone shaped nozzle 310 resembles a truncated cone. The cone shaped nozzle 310 and the muzzle chamber 315 form part of a venturi nozzle 352 that is an integral part of the suppressor 300. In one or more examples, the cone shaped nozzle 310 includes the muzzle chamber 315 at the muzzle end 305*a* of the unitary structure of the suppressor 300. In some examples, the cone shaped nozzle 310 is formed by the outer ring 385 extending from the faceplate 365 (and/or the conical wall 355) to the muzzle end 305*a* of the suppressor 300.

As shown in FIG. 3B, the breech end 305*b* includes an opening 320*a* that defines a portion of internal bore, such as a central bore 403 (illustrated in FIG. 4A), extending through the elongated body 302. At least a portion of the opening 320*a* at the breech end 305*b* includes a coupling device, such as threads, for coupling with or otherwise attaching to a barrel of a firearm (not shown). When coupled to a firearm, a projectile exiting the barrel enters the opening 320*a*, passes through the central bore 403 within the elongated body 302, and exits out of an opening 320*b* in the muzzle end 305*a*.

The breech end 305*b* also includes a plurality of cooling channels 325 that extends through the elongated body 302. The cooling channels 325 are in fluid communication with ambient air at the breech end 305*b* and extend through the elongated body 302 to the muzzle chamber 315 (illustrated in FIG. 4A), as further described and discussed below. The ambient air is the ambient gases surrounding the outside of the suppressor 300 and excludes the hot gases produced or otherwise generated by discharging a projectile (e.g., bullet) from a cartridge. The ambient air is at a lower temperature than the hot gases generated from the cartridge and passing through the central bore 403 and the cooling channels 325.

In some embodiments, the elongated body 302 includes a first section 330*a* and a second section 330*b*, as depicted in FIGS. 2A-2B. The first section 330*a* includes a first diameter 335*a* and the second section 330*b* includes a second diameter 335*b*. The first diameter 335*a* is greater than the second diameter 335*b* (alternatively, the second diameter 335*b* is less than the first diameter 335*a*). The reduced second diameter 335*b* of the second section 330*b* can be utilized to allow the suppressor 300 to fit within a handguard (not shown) that is typically utilized on conventional firearms. The enlarged first diameter 335*a* of the first section 330*a* is provided to maximize an internal volume of the elongated body 302. A transition region 340 is provided as an interface between the first section 330*a* and the second section 330*b*. In some embodiments, the enlarged first diameter 335*a* provides additional internal volume for a plurality of internal channels 360 (shown in FIGS. 4A, 4D, and 4F-4G).

The cone shaped nozzle 310 includes an inwardly angled outer sidewall 345 transitioning from the first diameter 335*a* to an annular ring section 350, as depicted in FIG. 4A. The annular ring section 350 includes a diameter (e.g., third diameter 335*c*) that is less than the first diameter 335*a* and the second diameter 335*b*. Thus, the geometry of the cone shaped nozzle 310 provides a constriction for gas (e.g., air and/or hot gases) as a projectile exits the muzzle end 305*a* of the suppressor 300.

The operation of the suppressor 300 is further explained in more detail as follows and in view of FIG. 4A. When a projectile is fired through the suppressor 300 and passes through the muzzle end 305*a* of the suppressor 300, a high-pressure gas/atmosphere and a shock wave are produced inside the muzzle chamber 315 of the cone shaped nozzle 310. The high-pressure gas/atmosphere inside the muzzle chamber 315 and the low pressure outside the suppressor 300 causes a Venturi-effect which pulls ambient air from the breech end 305*b* through the flow channels 325 and the elongated body 302. The ambient air passes over and/or through portions of the elongated body 302 removing heat from the elongated body 302 and other portions/parts of the suppressor 300. The heated air then exits into the muzzle chamber 315 and out of the muzzle end 305*a* of the suppressor 300.

In one or more examples, a Venturi-effect produced by the suppressor 300 causes fluid flow velocity to increase as the gases passes through a constriction provided by the geometry of the cone shaped nozzle 310 (e.g., the third diameter 335*c*), while the fluid's static pressure is decreased. Since the fluid molecules are flowing faster in the constriction, the pressure in the constriction (e.g., the muzzle chamber 315) should be lower than it is outside of the constriction. In order for the fluid molecules to speed up as they enter the constriction, and then slow down again as they leave the constriction, there must be a pressure difference at the entrance and exit of the constriction. When the velocity of the fluid increases, the fluid moves from greater pressure to lower pressure regions. As the fluid flows horizontally, the greatest speed occurs where the pressure is the lowest. The low-pressure ambient air at the muzzle end 305*a* of the suppressor 300 is moved into the channels 325 and rapidly across and/or through the elongated body 302 thus cooling the suppressor 300, reducing sound signature, reducing thermal signature, reducing flash signature, and/or extending operational life.

In some embodiments, as shown in FIGS. 3A-3B, the suppressor 300 includes a coating 390 disposed on the outer surface of the elongated body 302. The coating 390 effectively manages the visual and near-infrared (NIR) signature while at the same time enhancing thermal protection and durability. The coating 390 is applied to the suppressor 300 and allowed to cure until the coating 390 reaches a desired hardness and has desired chemical and physical properties. The coating 390 has a Wolff-Wilbourn (Pencil Hardness) test rating (ASTM D3363) of 9 h+, the highest hardness rating. Once cured the coating 390 has no odor, is RoHS and REACH compliant, and conforms to NIR reflectivity standards outlined in MIL-DTL-44436. In some embodiments, the elongated body 302 and/or the coating 390 includes a plurality of polygonal structures 395 having a plurality of raised sides 396. The polygonal structures 395 may be hexagons (e.g., having a hexagonal shape) as shown in FIGS. 3A-3B, or may be octagons, heptagons, pentagons, rectangles, squares, triangles, other polygons, other geometric shapes, or any combination or mixture thereof. The polygonal structures 395 increase the surface area of the elongated body 302, which enhances heat transfer for cooling the suppressor 300. In one or more examples, the polygonal structures 395 with the raised sides 396 are triangles (e.g., having a triangular shape) as shown on the suppressor 600 depicted in FIG. 6 and further described and discussed below.

FIGS. 4B-4G depict multiple views of the suppressor 300. FIG. 4B depicts a front view of the suppressor along lines 4B-4B illustrated in FIG. 3A, and FIG. 4C depicts a rear view of the suppressor along lines 4C-4C illustrated in FIG. 3B. FIG. 4D depicts a partial sectional front view of the suppressor along lines 4D-4D illustrated in FIG. 4A, and FIG. 4E depicts a partial sectional rear view of the suppressor along lines 4E-4E illustrated in FIG. 4A. FIG. 4F depicts an enlarged sectional view near the front of the suppressor within area 4F illustrated in FIG. 4A, and FIG. 4G depicts an enlarged sectional view near the rear of the suppressor within area 4G illustrated in FIG. 4A.

As shown in FIGS. 4A-4B and 4F, the suppressor 300 includes the venturi nozzle 352 formed at least in part by a volume defined by interior surfaces of the cone shaped nozzle 310 and a conical wall 355 inside the muzzle chamber 315. The venturi nozzle 352 also includes or otherwise formed partially within the inwardly angled outer sidewall 345. The conical wall 355 and the venturi nozzle 352 will be shown and described in more detail below.

The suppressor 300 also includes a plurality of internal channels 360 that is formed radially and/or longitudinally (lengthwise) inward of the cooling channels 325. While the cooling channels 325 extend from the breech end 305*b* of the suppressor 300 to the muzzle chamber 315, the internal channels 360 are in fluid communication with openings 424 (e.g., inlet or port) inside the elongated body 302 near one or more expansion chambers 418 of FIGS. 4A and 4E) and extend to and are open to the muzzle chamber 315 at the conical wall 355 and/or a faceplate 365. The plurality of cooling channels 325 are separated from the plurality of internal channels 360 by a longitudinal wall 362 and tubings 364. Each of the tubing 364 surrounds or otherwise defines each of the internal channels 360.

In one or more embodiments, each of the internal channels 360 has a first opening 424 (e.g., inlet or port) in the expansion chamber 418 within the interior volume 400 and a second opening 426 in the faceplate 365 and/or the conical wall 355. The internal channels 360 provide a passageway for hot gas travel while transferring heat from the gas to the unitary structure of the suppressor 300.

In some embodiments, the suppressor 300 contains a plurality of internal channels 360 which can have a number of channels 360 in a range from 2 channels, 3 channels, 4 channels, or 5 channels to 6 channels, 7 channels, 8 channels, 9 channels, channels, 11 channels, 12 channels, 13 channels, 14 channels, 15 channels, or more channels. For example, the plurality of internal channels 360 can have a number of channels 360 in a range from 2 channels to 15 channels, 2 channels to 12 channels, 2 channels to 10 channels, 2 channels to 8 channels, 2 channels to 6 channels, 2 channels to 5 channels, 2 channels to 4 channels, 2 channels to 3 channels, 3 channels to 15 channels, 3 channels to 12 channels, 3 channels to 10 channels, 3 channels to 8 channels, 3 channels to 6 channels, 3 channels to 5 channels, 3 channels to 4 channels, 4 channels to 15 channels, 4 channels to 12 channels, 4 channels to 10 channels, 4 channels to 8 channels, 4 channels to 6 channels, 4 channels to 5 channels, 5 channels to 15 channels, 5 channels to 12 channels, 5 channels to 10 channels, 5 channels to 8 channels, or 5 channels to 6 channels.

The plurality of internal channels 360 has a helical geometry extending around the central bore 403. The plurality of internal channels 360 encompasses or wraps around the central bore 403 multiple times or revolutions. For example, the plurality of internal channels 360 encompasses or wraps around the central bore 403 in a range from about 2 revolutions, about 3 revolutions, about 4 revolutions, about 5 revolutions, about 6 revolutions, about 7 revolutions, about 8 revolutions, about 9 revolutions, or about revolutions to about 12 revolutions, about 14 revolutions, about 15 revolutions, about 16 revolutions, about 18 revolutions, about 20 revolutions, about 22 revolutions, about revolutions, about 30 revolutions, or more. In one or more examples, the plurality of internal channels 360 encompasses or wraps around the central bore 403 in a range from about 3 revolutions to about 30 revolutions, about 3 revolutions to about 20 revolutions, about 5 revolutions to about 20 revolutions, about 6 revolutions to about 20 revolutions, about 8 revolutions to about 20 revolutions, about 10 revolutions to about 20 revolutions, about 12 revolutions to about 20 revolutions, about 15 revolutions to about revolutions, about 18 revolutions to about 20 revolutions, about 3 revolutions to about 14 revolutions, about 5 revolutions to about 14 revolutions, about 6 revolutions to about 14 revolutions, about 8 revolutions to about 14 revolutions, about 10 revolutions to about 14 revolutions, about 12 revolutions to about 14 revolutions, about 3 revolutions to about revolutions, about 5 revolutions to about 10 revolutions, about 6 revolutions to about revolutions, or about 8 revolutions to about 10 revolutions.

FIG. 4A depicts the longitudinal wall 362 spanning from the breech end 305*b* to the faceplate 365, where the longitudinal wall 362 is disposed radially inward of the outer ring 385, and a plurality of radially oriented walls 380 (depicted in FIG. 4C) extending between the longitudinal wall 362 and the outer ring 385. The plurality of cooling channels 325 is disposed between the longitudinal wall 362, the outer ring 385, and the radially oriented walls 380.

The internal channels 360 function to minimize overpressurization of internal regions of the elongated body 302 and will be further discussed below. In one or more embodiments, as shown in FIGS. 4A and 4D, the plurality of cooling channels 325 and the plurality of internal channels 360 terminate in the conical wall 355 and/or the faceplate 365. For example, each of the cooling channels 325 has a first opening at the breech end 305*b*, such as the breech face 370, and a second opening at the conical wall 355 and/or the faceplate 365. Also, each of the internal channels 360 has the opening 424 (depicted in FIGS. 4A and 4E) and a second opening at the faceplate 365 (depicted FIGS. 4A and 4D).

As shown in FIG. 4C, the plurality of cooling channels 325 is shown in a breech face 370 of the elongated body 302. Each of the cooling channels 325 includes one or more internal surfaces 375 and each cooling channel 325 is separated from one another by a radially oriented wall 380. Each of the radially oriented walls 380 is coupled to an outer ring 385 of the elongated body 302. In use, the cooling channels 325 are an effective heat sink. For example, when a projectile is fired through the suppressor 300, the internal surfaces 375, the radially oriented walls 380, and the outer ring 385 conduct and transfer heat. Ambient air which flows through the cooling channels 325 enters the breech end 305*b* and flows along the internal surfaces 375, the radially oriented walls 380, and the outer ring 385 (based on the Venturi-effect described above). The ambient air absorbs the heat from the internal surfaces 375, the radially oriented walls 380, and the outer ring 385 and in turn, the heated ambient air flows out of the cooling channels 325 and effectively removes heat from the elongated body 302 and away from the suppressor 300. In one or more embodiments, the internal surfaces 375 can be a cover layer 402 surrounding an inner periphery of the elongated body 302 within the cooling channels, as shown in FIGS. 4A and 4C. In other embodiments, not shown, the internal surfaces 375 can be the bare surfaces of the elongated body 302.

The internal channels 360 and the cooling channels 325 extend within the suppressor 300 and are radially outside of an internal volume 400 of the suppressor 300, as depicted in FIG. 4A. The plurality of cooling channels 325 is radially separated from the plurality of internal channels 360 by at least the longitudinal wall 362 and the tubing 364 which surrounds the internal channels 360 (shown in FIGS. 4A, 4D, 4F-4G) that is part of a primary structural frame 405. The plurality of internal channels 360 is at least partially separated from the internal volume 400 by the tubing that is part of the longitudinal wall 362 and the structural frame 405.

In one or more embodiments, the suppressor 300 includes a first portion 401*a* and a second portion 401*b*. The first portion 401*a* includes the venturi nozzle 352 and the muzzle chamber 315. The second portion 401*b* includes the remainder of the elongated body 302 of the suppressor 300, as well as the internal volume 400. In some embodiments, a ratio of the empty volume of the internal volume 400 (e.g., between the cover layer 402 surrounding an inner periphery of the elongated body 302 and adjacent to any solid portions within the inside surface of the cover layer 402) to the volume of the muzzle chamber 315 is about 85%:15%. The term "about" in this context means +/−3%. In some embodiments, such as for an M-240 firearm, the internal volume 400 is about 16 cubic inches to about 18 cubic inches, or about 17 cubic inches to about 17.8 cubic inches, for example about 17.5 cubic inches. In contrast, the volume of the venturi nozzle 352 (or muzzle chamber 315) is about 2.8 cubic inches to about 3.2 cubic inches, for example about 3 cubic inches. The term "about" in this context means +/−0.2 cubic inches. Thus, a ratio of the volume of the internal volume 400 relative to the volume of the muzzle chamber 315 is 5.8:1 in some embodiments. In other embodiments, such as for an M-249 firearm, the volumes described above may be reduced by 15%. In other examples, the internal volume 400 is about 12 cubic inches to about 22 cubic inches, about 14 cubic inches to about 20 cubic inches, about 16 cubic inches to about 18 cubic inches, or about 17 cubic inches to about 17.8 cubic inches, for example about 17.5 cubic inches.

The central bore 403, sized to allow a projectile to pass therethrough, is shown along a length of the elongated body 302. Threads 404 are shown in the opening 320 of the breech face 370. The threads 404 are used to couple or otherwise attach the suppressor 300 to a barrel of a firearm (not shown).

The internal volume 400 includes the primary structural frame 405 providing a majority of the rigidity of the elongated body 302. The structural frame 405 includes a varying cross-section along a length of the elongated body 302. The structural frame 405 includes a plurality of baffles 410. The baffles 410 serve to disrupt gas flow within the internal volume 400 and absorb heat, which aids in reducing sound levels when firing a projectile through the suppressor 300. The plurality of baffles 410 extends around the central bore 403 and between the breech end 305*b* and the cone shaped nozzle 310. In one or more embodiments, the baffle 410 closest to the cone shaped nozzle 310 is the last baffle within the plurality of baffles 410 and can also be or include the conical wall 355, the faceplate 365, or a combination thereof.

Each of the baffles 410 independently extends from the longitudinal wall 362 into the internal volume 400 at an angle relative to horizontal (e.g., the Y-X plane), such as the longitudinal wall 362. In one or more embodiments, each of the baffles 410 independently extends from the longitudinal wall 362 at an angle within a range from about 20° to about 90°, such as about 30° to about 80°, about 35° to about 75°, about to about 70°, about 40° to about 65°, about 40° to about 60°, about 40° to about 55°, about 40° to about 50°, about 40° to about 45°, about 45° to about 70°, about 45° to about about 45° to about 60°, about 45° to about 55°, about 45° to about 50°, about 50° to about 70°, about 50° to about 65°, about 50° to about 60°, about 50° to about 55°, about to about 70°, or about 60° to about 65°.

In some embodiments, the plurality of baffles 410 contains a continuous ribbon structure having a helical geometry extending around the central bore 403. The continuous ribbon structure of baffles 410 encompasses or otherwise wraps around the central bore 403 with multiple revolutions. The plurality of baffles 410 can have revolutions in a range from 3 revolutions, 4 revolutions, 5 revolutions, 6 revolutions, 7 revolutions, 8 revolutions, 9 revolutions, or 10 revolutions to about 12 revolutions, about 14 revolutions, about 15 revolutions, about 16 revolutions, about 18 revolutions, about revolutions, about 22 revolutions, about 25 revolutions, about 28 revolutions, about revolutions, or more. For example, the plurality of baffles 410 can have revolutions in a range from about 3 revolutions to about 30 revolutions, about 3 revolutions to about 25 revolutions, about 3 revolutions to about 20 revolutions, about 3 revolutions to about 18 revolutions, about 3 revolutions to about 14 revolutions, about 3 revolutions to about 12 revolutions, about 3 revolutions to about 10 revolutions, about 3 revolutions to about 8 revolutions, about 3 revolutions to about 5 revolutions, about 6 revolutions to about 30 revolutions, about 6 revolutions to about 25 revolutions, about 6 revolutions to about 20 revolutions, about 6 revolutions to about 18 revolutions, about 6 revolutions to about 14 revolutions, about 6 revolutions to about 12 revolutions, about 6 revolutions to about 10 revolutions, about 6 revolutions to about 8 revolutions, about 8 revolutions to about 30 revolutions, about 8 revolutions to about 25 revolutions, about 8 revolutions to about 20 revolutions, about 8 revolutions to about 18 revolutions, about 8 revolutions to about 14 revolutions, about 8 revolutions to about 12 revolutions, or about 8 revolutions to about 10 revolutions.

A portion of the structural frame 405 within the second section 330*b* of the elongated body 302 acts as a heat sink. The heat sink, generally located at the breech end 305*b* where temperatures may be the greatest during firing of a projectile, absorbs at least a portion of the thermal energy from the firing of the projectile via conduction, convection and/or radiation. The heat sink (e.g., the portion of the structural frame 405) transfers the thermal energy to ambient air via the cooling channels 325 using the Venturi-effect from the venturi nozzle 352 (or muzzle chamber 315) when a projectile is fired.

During use of the suppressor 300, a fired projectile passes through the suppressor 300 from the breech end 305*b* to the muzzle end 305*a* via the opening 320*a*, the central bore 403, and the opening 320*b*. The hot gases derived from the cartridge of the projectile enters the central bore 403 from the opening 320*a* and enters the plurality of internal channels 360 from the first opening or port 224. The hot gases flow through the central bore 403 and the plurality of internal channels 360 and exit into the muzzle chamber 315. As the hot gases pass through the muzzle chamber 315, the Venturi-effect is produced by the hot gases which pull the ambient air through the first openings 326, along the cooling channels 325, and out of the second openings 328. The hot gasses and the ambient air combine in the muzzle chamber 315 and exit the suppressor 300 at the breech end 305*b*.

In one or more embodiments, the interface of the elongated body 302 and the cone shaped nozzle 310 form a venturi angle $\alpha_2$ facing inward into the internal volume 400, as depicted in FIG. 4A. It has been a surprising and unexpected discovery that a desired range in the value of the venturi angle $\alpha_2$ provides enhanced results via the Venturi-effect to maximize the flowrate of the ambient air through the cooling channels 325 during use of the suppressor 300. As such, the suppressor 300 has a reduction in heat (e.g., stays cooler during use), as well as provides a reduction in sound audible and a reduction in flash at the muzzle, such as at the annular ring section 350. The outside surfaces, as well as many inner surfaces, of the suppressor 300 stay cooler during use relative to traditional suppressors which lack the synergistic attributes of the cooling channels 325 and the venturi angle $\alpha_2$.

The venturi angle $\alpha_2$ can have a value of about 140°, about 150°, about 152°, about 155°, about 156°, about 157°, about 158°, about 159°, or about 160° to about 161°, about 162°, about 163°, about 163°, about 165°, about 166°, about 168°, about 170°, about 172°, about 174°, or about 175°. For example, the venturi angle $\alpha_2$ can have a value in a range from about 140° to about 175°, about 145° to about 175°, about 148° to about 175°, about 150° to about 175°, about 152° to about 175°, about 155° to about 175°, about 158° to about 175°, about 160° to about 175°, about 162° to about 175°, about 165° to about 175°, about 140° to about 170°, about 145° to about 170°, about 148° to about 170°, about 150° to about 170°, about 152° to about 170°, about 155° to about 170°, about 158° to about 170°, about 160° to about 170°, about 162° to about 170°, about 165° to about 170°, about 140° to about 168°, about 145° to about 168°, about 148° to about 168°, about 150° to about 168°, about 152° to about 168°, about 155° to about 168°, about 158° to about 168°, about 160° to about 168°, about 162° to about 168°, about 165° to about 168°, about 140° to about 165°, about 145° to about 165°, about 148° to about 165°, about 150° to about 165°, about 152° to about 165°, about 155° to about 165°, about 158° to about 165°, about 160° to about 165°, about 162° to about 165°, or about 163° to about 165°.

As mentioned above, the internal channels 360 are inside the elongated body 302 and are disposed radially inward of the cooling channels 325. The internal channels 360 may be referred to as "redirect nozzles". The internal volume 400 also includes one or more expansion chambers 418 located within the elongated body 302. The expansion chamber 418 can be blast chambers 420 and/or expansion chambers. Each of the internal channels 360 have the opening 424 that is positioned adjacent to, and/or is in fluid communication with, one or more expansion chambers 418. As a projectile is fired, the expansion chamber 418 fills with high pressure/high heat gasses. When the gasses reach the expansion chamber 418, a portion of the gasses are redirected through the openings 424. This allows a first portion of the gasses to pass into the internal channels 360 and a second portion of the gasses to continue within the elongated body 302, along the central bore 403, into the muzzle chamber 315 and out of the annular ring section 350 and the muzzle end 305*a*. By allowing gasses to free flow out of the internal volume 400, the expansion chamber 418, openings 424, and the internal channels 360, back pressures are significantly decreased while having less of an impact of the cyclic rate of the host weapon which reduces wear. Redirecting gasses from the blast chambers 220 allows the highest temperature and pressure gasses to move unimpeded directly into the nozzle area, avoiding any disruption and minimizing heat loss. By redirecting the gasses directly into the nozzle from the blast chamber 220, the heat and high pressure increases the atmospheric pressure inside the muzzle chamber 315 of the cone shaped nozzle 310. The redirect nozzles (e.g., the internal channels 360) increase air speed over the cooling channels 325 by approximately 40%.

In one or more embodiments, the unitary structure of the suppressor 300 contains a flash hider 450 extending from the conical wall 355 and/or the faceplate 365 into the muzzle chamber 315 within the cone shaped nozzle 310. The flash hider 450 is integral to the elongated body 302 of the suppressor 300. The flash hider 450 and the conical wall 355 form a portion of the venturi nozzle 352 for directing gases out of the muzzle end 305*a*. The flash hider 450 reduces or suppresses flash energy from the firing of a projectile through the suppressor 300. In some embodiments, the flash hider 450 is utilized to redirect a portion of the propellant gases from a fired projectile to counter recoil n the firearm and/or "muzzle rise" which may interfere with accuracy of the firearm. Additionally or alternatively, the flash hider 450 redirects sound forward (toward the muzzle end 305*a*), away from the shooter of the firearm.

The flash hider 450 contains one, two, or more prongs 452 disposed within the elongated body 302, as depicted in FIGS. 4A-4B, 4D, and 4F. The central bore 403 passes between the prongs 452, such that the flash hider 450 is aligned along the central bore 403 and the one or more prongs 452 encompass or encircle the central bore 403. The flash hider 450 can be in the first portion 401*a*, the second portion 401*b*, or both the first portion 401*a* and the second portion 401*b* of the suppressor 300. As shown in FIG. 4A, the flash hider 450 can be coupled to the conical wall 355 and/or one of the baffles 410, such as the baffle 410 closest to the muzzle end 305*a*, and extends out into the muzzle chamber 315. In one or more embodiments, the flash hider 450 and the conical wall 355 are monolithic or unitary as a single component. In other embodiments, the flash hider 450 and the baffle 410 are monolithic or unitary as a single component.

In one or more embodiments, the flash hider 450 contains a plurality of the prongs 452 extending into the muzzle chamber 315. The flash hider 450 can have 2, 3, or 4 prongs to 5, 6, 7, 8, 9, or 10 prongs. As shown in the Figures, the flash hider 450 contains 4 prongs 452. In some examples, the flash hider 450 contains from 2 prongs to prongs, 2 prongs to 8 prongs, 2 prongs to 6 prongs, 2 prongs to 5 prongs, 2 prongs to 4 prongs, 2 prongs to 3 prongs, 3 prongs to 10 prongs, 3 prongs to 8 prongs, 3 prongs to 6 prongs, 3 prongs to 5 prongs, or 3 prongs to 4 prongs.

FIGS. 5A-5C depict the plurality of baffles 410 surrounding the central bore 403 and containing the plurality of internal channels 360. The longitudinal wall 362 and a portion of each tubings 364, as shown in previous Figures, are not illustrated in Figures in order to depict an unobstructed view of the plurality of internal channels 360 within the tubings 364. As such, FIG. 5A depicts an isometric side view of a portion of the suppressor 300 in absence of at least a portion of or most of the outer ring 385. FIG. 5B depicts an isometric front view of the portion of the suppressor 300 illustrated in FIG. 5A. FIG. 5C depicts a partial view of the portion of the suppressor 300 along lines 5A-5A illustrated in FIG. 5A.

It has been surprisingly and unexpectedly found that the flash hider 450 greatly reduces or suppresses flash energy, such as light from the visible spectrum and/or infrared spectrum, when a cartridge is discharged and a projectile passes through the suppressor 300 compared to a similar suppressor without a flash hider under the same conditions. In one or more embodiments, the suppressor 300 with the flash hider 450 reduces or suppresses flash energy to a value of less than 12 mcd·s, less than 10 mcd·s, and lower, according to the NATO Standard AEP-4785, Volume II (Test Procedure for Flash Intensity Measurement in the Visible and Infrared Spectrum for Small Arms).

In one or more examples, the suppressor 300 with the flash hider 450 reduces or suppresses flash energy to a value in a range from about 0.2 mcd·s, about 0.5 mcd·s, about 0.8 mcd·s, about 1 mcd·s, or about 1.5 mcd·s to about 1.8 mcd·s, about 2 mcd·s, about 2.5 mcd·s, about 3 mcd·s, about 4 mcd·s, about 5 mcd·s, about 6 mcd·s, about 7 mcd·s, about 8 mcd·s, about 9 mcd·s, about 10 mcd·s, about 12 mcd·s, about 15 mcd·s, about 18 mcd·s, or about 20 mcd·s, according to the NATO Standard AEP-4785, Volume II. For example, the suppressor 300 with the flash hider 450 reduces or suppresses flash energy to a value in a range from about 0.2 mcd·s to about 20 mcd·s, about 0.2 mcd·s to about 15 mcd·s, about 0.2 mcd·s to about 10 mcd·s, about 0.2 mcd·s to about 8 mcd·s, about 0.2 mcd·s to about 6 mcd·s, about 0.2 mcd·s to about 5 mcd·s, about 0.2 mcd·s to about 4 mcd·s, about 0.2 mcd·s to about 3 mcd·s, about 0.2 mcd·s to about 2 mcd·s, about 0.2 mcd·s to about 1 mcd·s, about 0.2 mcd·s to about 0.8 mcd·s, about 1 mcd·s to about 20 mcd·s, about 1 mcd·s to about 15 mcd·s, about 1 mcd·s to about 10 mcd·s, about 1 mcd·s to about 8 mcd·s, about 1 mcd·s to about 6 mcd·s, about 1 mcd·s to about 5 mcd·s, about 1 mcd·s to about 4 mcd·s, about 1 mcd·s to about 3 mcd·s, about 1 mcd·s to about 2 mcd·s, about 1 mcd·s to about 1.5 mcd·s, about 5 mcd·s to about 20 mcd·s, about 5 mcd·s to about 18 mcd·s, about 5 mcd·s to about 15 mcd·s, about 5 mcd·s to about 12 mcd·s, about 5 mcd·s to about 10 mcd·s, about 5 mcd·s to about 8 mcd·s, or about 5 mcd·s to about 6 mcd·s, according to the NATO Standard AEP-4785, Volume II.

Figure 6:
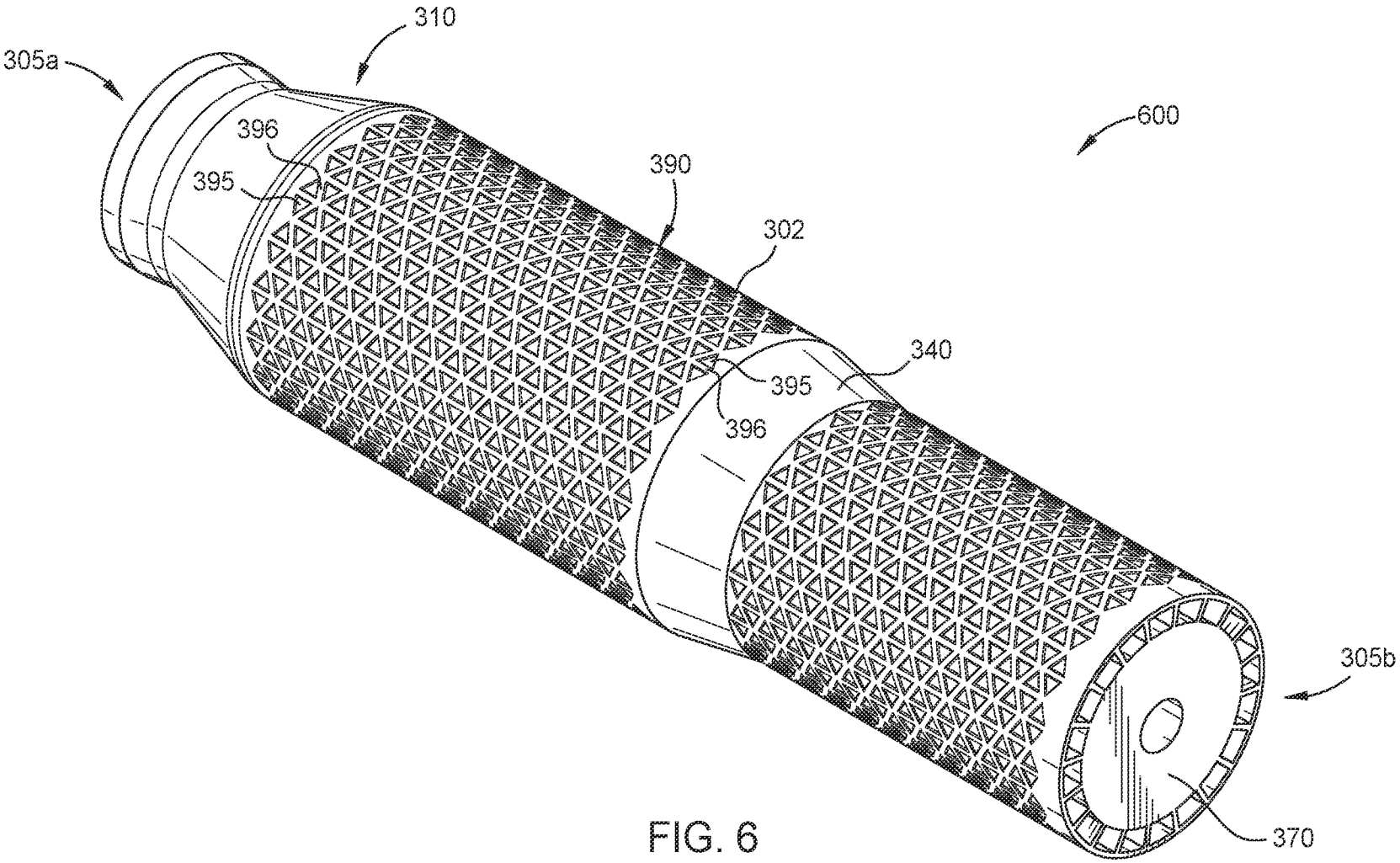
FIG. 6 depicts an isometric rear view of a suppressor having a triangular pattern along the elongated body, according to one or more embodiments.

FIG. 6 depicts an isometric rear view of a suppressor 600 having the polygonal structures 395 as a triangular pattern along the elongated body 302, according to one or more embodiments. Identical reference numerals on the suppressors 300 and 600 have been used, where possible, to designate identical elements that are common to the Figures. In one or more examples, the polygonal structures 395 with the raised sides 396 are triangles (e.g., having a triangular shape) as shown on the elongated body 302. The triangular pattern of the polygonal structures 395 can include different size triangles throughout the pattern and/or can include triangles facing a variety of different directions throughout the pattern (not shown). As depicted in FIG. 6, the triangular pattern of the polygonal structures 395 are the same size or substantially the same size of triangles throughout the pattern. Also, the polygonal structures 395 are aligned in rows of alternating facing triangles along the length on the suppressor 600, where each pair of the triangles are circumferentially aligned point away from each other.

In one or more embodiments, the suppressor 300 has a unitary structure which can be or include the elongated body 302 having the plurality of baffles 410 surrounding the central bore 403. The elongated body 302 has the interior volume 400 and the cone shaped nozzle 310 disposed at one end of the elongated body 302. The elongated body 302 has the breech end 305*b* opposite the faceplate 365 and/or the conical wall 355 and contains the plurality of cooling channels 325 spanning a length of the elongated body 302. The central bore 403 extends from the breech end 305*b* of the elongated body 302 to at least the faceplate 365 and/or the conical wall 355. The plurality of cooling channels 325 terminates at the faceplate 365 and/or the conical wall 355 and into the cone shaped nozzle 310. Each of the cooling channels 325 has the first opening 326 at the breech end 305*b* and the second opening 328 at the faceplate 365 (and/or the conical wall 355).

The suppressor 300 further contains the outer ring 385 spanning from the breech end 305*b* to at least the faceplate 365 and/or the conical wall 355, the longitudinal wall 362 spanning from the breech end 305*b* to the faceplate 365 and/or the conical wall 355, where the longitudinal wall 362 is disposed radially inward of the outer ring 385, and a plurality of radially oriented walls 380 extending between the longitudinal wall 362 and the outer ring 385. The plurality of cooling channels 325 is disposed between the longitudinal wall 362, the outer ring 385, and the radially oriented walls 380.

The suppressor 300 further contains a flash hider 450 extending from the faceplate 365 and/or the conical wall 355 into a muzzle chamber 315 within the cone shaped nozzle 310. The flash hider 450 has from two prongs 452 to eight prongs 452 extending into the muzzle chamber 315 and the central bore 403 passes between the prongs 452. In some examples, the outer ring 385 and the cone shaped nozzle 310 form a venturi angle having a range from about 155° to about 170° within the unitary structure of the suppressor 300.

While the foregoing is directed to embodiments of the disclosure, other and further embodiments may be devised without departing from the basic scope thereof, and the scope thereof is determined by the claims that follow. All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, the term "comprising" is considered synonymous with the term "including" for purposes of United States law. Likewise, whenever a composition, an element, or a group of elements is preceded with the transitional phrase "comprising", it is understood that the same composition or group of elements with transitional phrases "consisting essentially of", "consisting of", "selected from the group of consisting of", or "is" preceding the recitation of the composition, element, or elements and vice versa, are contemplated. As used herein, the term "about" refers to a +/−10% variation from the nominal value. It is to be understood that such a variation can be included in any value provided herein.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

What is claimed is:

1. A suppressor, comprising:

a unitary structure comprising:

a body having an interior volume and a cone shaped nozzle disposed at one end of the body, wherein the body has a breech end opposite a faceplate and comprises a plurality of cooling channels spanning a length of the body, wherein the plurality of cooling channels terminates at the faceplate of the body, and each of the cooling channels has a first opening at the breech end and a second opening at the faceplate, and wherein the unitary structure further comprises:

an outer ring spanning from the breech end to at least the faceplate;

a longitudinal wall spanning from the breech end to the faceplate, wherein the longitudinal wall is disposed radially inward of the outer ring; and a plurality of radially oriented walls extending between the longitudinal wall and the outer ring, wherein the plurality of cooling channels is disposed between the longitudinal wall, the outer ring, and the radially oriented walls, a central bore extending from the breech end of the body to the faceplate; and a plurality of baffles surrounding the central bore;

wherein the unitary structure further comprises a plurality of internal channels disposed radially inward of the cooling channels; and wherein each of the internal channels has a first opening in the interior volume and a second opening in the faceplate.

2. The suppressor of claim 1, wherein the plurality of internal channels has a helical geometry extending around the central bore.

3. The suppressor of claim 2, wherein the plurality of internal channels encompasses the central bore in a range from about 3 revolutions to about 20 revolutions.

4. The suppressor of claim 1, wherein the plurality of internal channels comprises from 3 channels to 12 channels.

5. The suppressor of claim 1, wherein the plurality of cooling channels are separated from the plurality of internal channels by the longitudinal wall.

6. The suppressor of claim 1, wherein the unitary structure further comprises a flash hider extending from the faceplate into a muzzle chamber within the cone shaped nozzle.

7. The suppressor of claim 6, wherein the flash hider comprises from 2 prongs to 6 prongs extending into the muzzle chamber, and wherein the central bore passes between the prongs.

8. The suppressor of claim 1, wherein the plurality of baffles comprises a continuous ribbon structure having a helical geometry extending around the central bore.

9. The suppressor of claim 8, wherein the continuous ribbon structure encompasses the central bore in a range from about 3 revolutions to about 20 revolutions.

10. The suppressor of claim 1, wherein the body and the cone shaped nozzle form a venturi angle having a range from about 155° to about 170° within the unitary structure.

11. The suppressor of claim 1, wherein the body includes a first section having a first diameter and a second section having a second diameter that is less than the first diameter.

12. The suppressor of claim 1, wherein the cone shaped nozzle includes a muzzle chamber at a muzzle end of the unitary structure.

13. The suppressor of claim 12, wherein the unitary structure incudes a first portion including the muzzle chamber and a second portion including the interior volume, and a volumetric ratio of the interior volume relative to the muzzle chamber is about 85%:15%.

14. The suppressor of claim 1, wherein the cone shaped nozzle is formed by the outer ring extending from the faceplate to a muzzle end of the unitary structure.

15. A suppressor, comprising:

a unitary structure comprising:

a body having an interior volume and a cone shaped nozzle disposed at one end of the body, wherein the body has a breech end opposite a faceplate and comprises a plurality of cooling channels spanning a length of the body, wherein the plurality of cooling channels terminates at the faceplate of the body, and each of the cooling channels has a first opening at the breech end and a second opening at the faceplate, and wherein the unitary structure further comprises:

an outer ring spanning from the breech end to at least the faceplate;

a longitudinal wall spanning from the breech end to the faceplate, wherein the longitudinal wall is disposed radially inward of the outer ring;

a plurality of radially oriented walls extending between the longitudinal wall and the outer ring, wherein the plurality of cooling channels is disposed between the longitudinal wall, the outer ring, and the radially oriented walls; and a flash hider extending from the faceplate into a muzzle chamber within the cone shaped nozzle, wherein the flash hider comprises from 2 prongs to 8 prongs extending into the muzzle chamber, and wherein a central bore passes between the prongs; and a plurality of baffles surrounding the central bore;

wherein the unitary structure further comprises a plurality of internal channels disposed radially inward of the cooling channels; and wherein the plurality of internal channels has a helical geometry extending around the central bore, wherein the plurality of internal channels encompasses the central bore in a range from about 3 revolutions to about 20 revolutions.

* * * * *